US007004896B2

(12) United States Patent
Heitmann et al.

(10) Patent No.: US 7,004,896 B2
(45) Date of Patent: Feb. 28, 2006

(54) METHOD AND ARRANGEMENT FOR PRODUCING COMPOUND FILTERS

(75) Inventors: Uwe Heitmann, Hamburg (DE); Sönke Horn, Geesthacht (DE); Nikolaos Georgitsis, Hamburg (DE); Heinz-Christen Lorenzen, Wentorf (DE); Steffen Rocktäschel, Lüneburg (DE); Stephan Wolff, Glinde (DE); Wolfgang Steiniger, Geesthacht (DE); Gerd Strohecker, Marschacht (DE); Andreas Rinke, Bad Oldesloe (DE); Hans-Herbert Schmidt, Hamburg (DE)

(73) Assignee: Hauni Maschinenbau GmbH, Hamburg (DE)

( * ) Notice: Subject to any disclaimer, the term of this patent is extended or adjusted under 35 U.S.C. 154(b) by 283 days.

(21) Appl. No.: 10/058,200

(22) Filed: Jan. 29, 2002

(65) Prior Publication Data

US 2002/0119874 A1 Aug. 29, 2002

(30) Foreign Application Priority Data

Jan. 29, 2001 (DE) ..... 101 05 010
Jan. 29, 2001 (DE) ..... 101 05 011

(51) Int. Cl.
*B31C 13/00* (2006.01)

(52) U.S. Cl. ..... 493/39; 493/42; 493/50

(58) Field of Classification Search ..... 493/42, 493/39, 50; 131/280, 38, 39, 282
See application file for complete search history.

(56) References Cited

U.S. PATENT DOCUMENTS

| | | | | |
|---|---|---|---|---|
| 3,259,029 | A * | 7/1966 | Hall et al. | 493/4 |
| 3,370,514 | A | 2/1968 | Rome | |
| 3,550,508 | A | 12/1970 | Wartman, Jr. et al. | |
| 3,603,058 | A | 9/1971 | Schubert | |
| 3,831,610 | A * | 8/1974 | Wochnowski et al. | 131/108 |
| 3,834,285 | A | 9/1974 | Schubert et al. | |
| 3,837,264 | A | 9/1974 | Sexstone | |
| 4,209,955 | A * | 7/1980 | Seragnoli | 53/54 |
| 4,782,644 | A | 11/1988 | Haarer et al. | |
| 4,848,372 | A * | 7/1989 | Molins | 131/282 |
| 4,862,905 | A * | 9/1989 | Green, Jr. et al. | 493/49 |
| 5,018,539 | A * | 5/1991 | Gamberini et al. | 131/280 |
| 5,178,166 | A * | 1/1993 | Newsome et al. | 131/336 |
| 5,209,249 | A | 5/1993 | Neri | |
| 5,349,968 | A * | 9/1994 | Rizzoli et al. | 131/94 |
| 6,079,545 | A | 6/2000 | Dombek | |
| 6,427,699 | B1 * | 8/2002 | Schlisio et al. | 131/94 |
| 6,443,160 | B1 * | 9/2002 | Boldrini et al. | 131/280 |

FOREIGN PATENT DOCUMENTS

| | | |
|---|---|---|
| DE | 17 82 364 | 10/1971 |
| DE | 39 25 073 | 2/1990 |
| DE | 197 08 836 | 9/1998 |
| EP | 1 048 229 | 11/2000 |
| FR | 2.147.657 | 3/1973 |
| GB | 741416 | 12/1955 |
| GB | 1 212 963 | 11/1970 |
| GB | 1 219 744 | 1/1971 |
| GB | 1 243 977 | 8/1971 |
| GB | 1 251 241 | 10/1971 |

* cited by examiner

*Primary Examiner*—Eugene Kim
(74) *Attorney, Agent, or Firm*—Venable LLP; Robert Kinberg; Catherine M. Voorhees

(57) ABSTRACT

A method and arrangement are provided for producing compound filters for products in the tobacco-processing industry. A filter tube, having a filter element in a central region of the filter tube, is supplied to a predetermined position. Predetermined portions of filtering material are then inserted into the filter tube from at least a first end of the filter tube so that filter segments form in at least a first part of the filter tube.

47 Claims, 16 Drawing Sheets

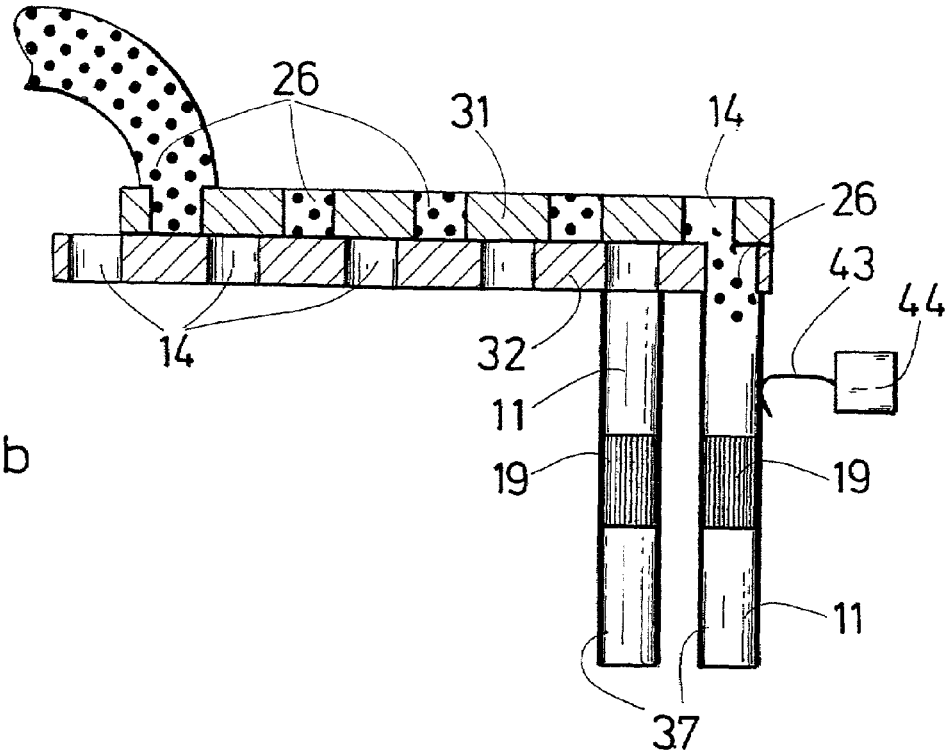
Fig. 10b
Fig. 10a
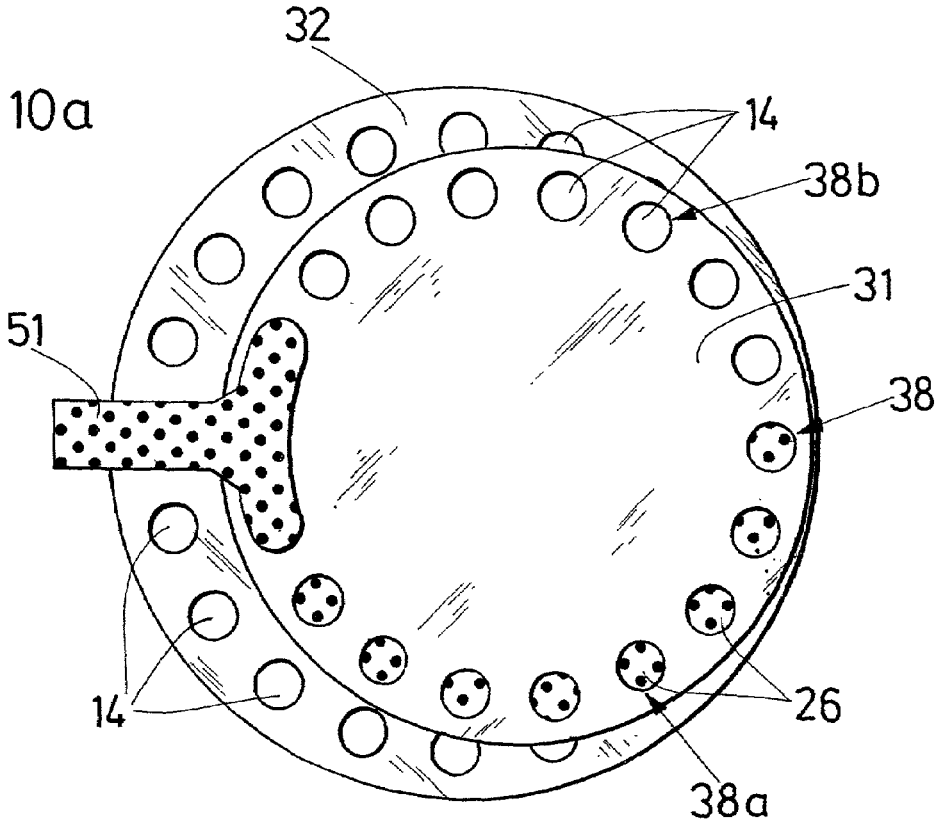

Fig. 14a
Fig. 14b
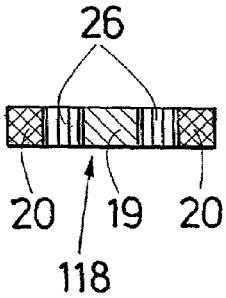
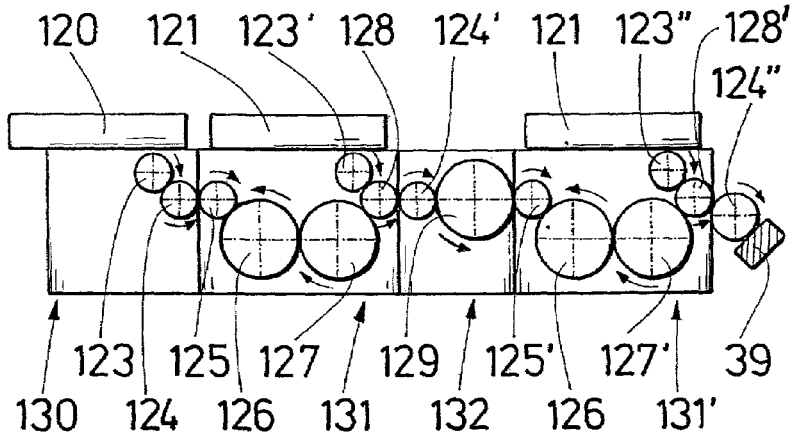

Fig. 17
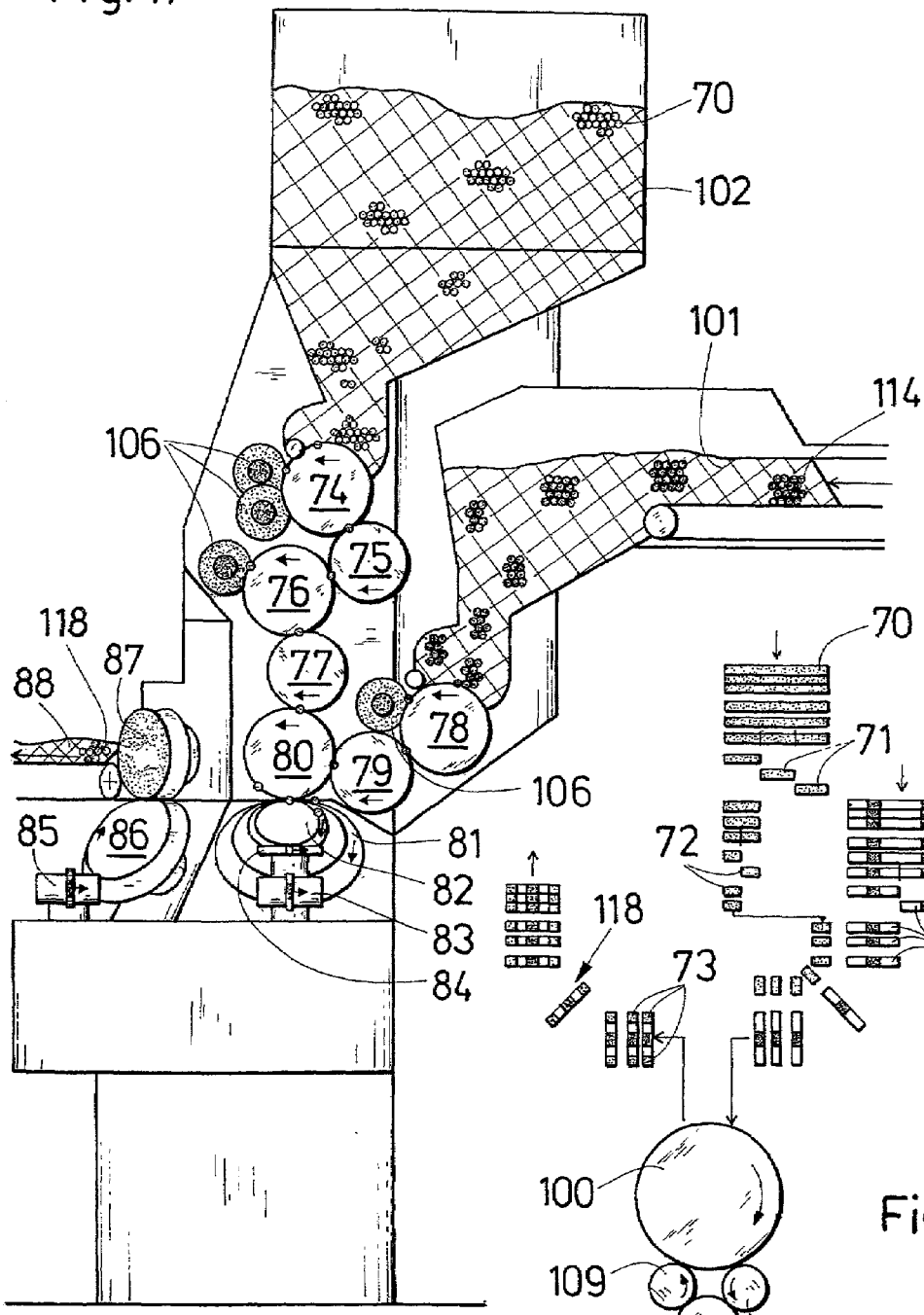
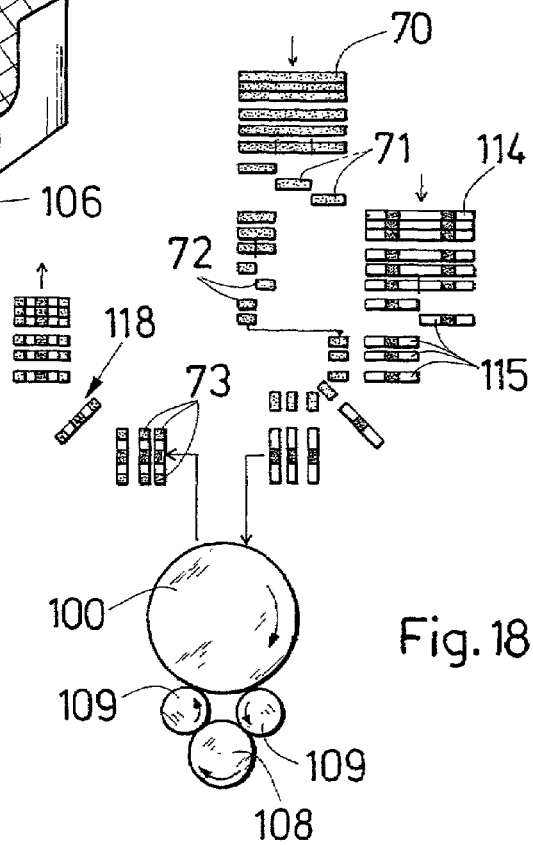
Fig. 18

METHOD AND ARRANGEMENT FOR PRODUCING COMPOUND FILTERS

CROSS-REFERENCE TO RELATED APPLICATION

Priority is claimed herein with respect to German Patent Application Serial Nos. 101 05 010.0 and 101 05 011.9, both filed on Jan. 29, 2001, the subject matter of which, along with the subject matter of each and every U.S. and foreign patent document mentioned herein, is incorporated herein by reference.

BACKGROUND OF THE INVENTION

The invention relates to a method and an arrangement for producing compound filters for products in the tobacco-processing industry. An arrangement of the character to which the present invention relates includes a filter tube feeding element and at least one conveying element, into which the filter tubes are inserted and which supply or supplies these filter tubes to at least one processing station. The invention furthermore relates to the use of pre-manufactured filter tubes for producing compound filters for products in the tobacco-processing industry, a corresponding filter tube for producing compound filters for products in the tobacco-processing industry, as well as a compound filter-manufacturing system for the products, which system comprises a filter tube feeding device and a conveying system for conveying the filter tubes along a predetermined movement path.

Published German Patent Application No. 17 82 364, owned by the assignee of the present application, discloses a method and arrangement for producing compound filters, and in particular describes an arrangement, commercially known as the "Bernhard" machine and distributed by the present assignee, for producing filters containing filter granules. Published German Patent Application No. 17 82 364 corresponds to British Patent No. 1.243.977 and to U.S. Pat. No. 3,603,058 granted on Sep. 7, 1971 to Bernhard Schubert for "Method and Apparatus for the Production of Composite Filter Tips." Compound filters, also referred to as multi-segment filters, produced by the "Bernhard" machine consist of at least two and typically up to eight filter elements, arranged in an optional sequence. Different filter elements or segments are arranged inside a casing or sleeve in the shape of a tube. The filter elements can include soft filter elements such as cellulose acetate, paper, fleece, or relatively hard filter elements such as granules, sintered elements, hollow-cylinders or hollow-chambers and capsules and the like. It is not necessary for the respective filtering materials to consist 100% of a single type of material. For example, the filtering material can comprise mixed materials such as granules in a cellulose acetate and can include granulated materials such as active charcoal. The properties of compound filters can vary extremely, depending on the materials used and the filter-segment sequence. These filters are preferably attached to the end of rod-shaped tobacco articles such as cigarettes, cigars, cigarillos, and analogous rod-shaped smokers'products.

The granulate-filling machine described in U.S. Pat. No. 3,603,058 to Schubert produces filters containing granulate, and in particular triple filters. A triple filter is understood to be a filter consisting of three filter segments. The above mentioned Bernhard filling machine produces a triple filter of twice unit length. For cigarette production, the filter is arranged between two long, tobacco-containing articles wrapped in cigarette paper and is then cut in the center to obtain two cigarettes provided with a filter. U.S. Pat. No. 3,603,058 to Schubert discloses a continuously circulating conveyor with receptacles for the filter tubes for conveying the filter tubes cross-axially. During the cross-axial conveying, filter plugs cut from a longer filter rod and granulate are alternately inserted into the tube. The filter plugs are pushed into the tube with the aid of a transfer mechanism in the form of a plunger or push rod while the granulated material drops into the tube under the effect of gravity.

The relatively numerous steps required for operating the "Bernhard" machine, in particular the necessity for relatively far-reaching movements, limit the output of the granulate-filling machine described in U.S. Pat. No. 3,603,058 to Schubert. Given the increasingly higher output of cigarette-production machines, there is a need to accelerate the production of corresponding filters as well.

SUMMARY OF THE INVENTION

It is an object of the present invention to provide a method and an arrangement, as well as a compound filter-manufacturing system, which can increase the production output of compound filters.

The above and other objects are accomplished in accordance with the present invention by the provision of a method for producing compound filters for products in the tobacco-processing industry, comprising the operational steps of: supplying a filter tube, having a filter element in a central region of the filter tube, to a predetermined position; and inserting predetermined portions of filtering material into the filter tube from at least a first end of the filter tube so that filter segments are formed in at least a first part of the filter tube.

As a result of supplying a filter tube that already contains a filter element in the center and filling predetermined portions of filtering material into this filter tube, the movements that must be carried out by the feeding elements to insert the filtering material into the filter tube can be kept relatively short, thus resulting in a considerable time advantage. The filter tube with the centrally arranged filter element is preferably made available and/or manufactured in a preceding operational step.

It is to be understood herein that within the framework of this invention a compound filter is a multi-segment filter, comprising at least two segments and at least two filtering materials. Compound filters generally consist of two or three or more segments, for example a soft segment made from cellulose acetate, followed by a granulate such as active charcoal filter granulate, followed by another cellulose acetate soft element. For a triple filter of this type, a wrapping material such as paper is preferably fitted around this filter. When using a filter tube with a filter element in the center, it is standard practice to produce compound filters of two or more times the unit length.

The filter element or plug in the center of the filter tube is maintained in the center position through a force or by fitting a corresponding element against it. Alternatively, the plug may be glued in or kept in the center with corresponding frictional forces. Suction air, for example, can be used to keep the tube in a desired position.

According to a further advantageous feature of the invention, the filter tube is rotated so that filtering material can be inserted from a second (i.e. other) end of the filter tube to form additional filter segments in a second part of the filter tube. Gravity can thus be utilized for filling granulated material from both ends into the filter tube. Furthermore, corresponding filling stations or processing stations can be arranged along one side of a corresponding conveyor that is provided with receptacles for holding the filter tubes, thereby resulting in a compact design for a machine of this type.

It is further understood that within the framework of the present invention, filter tubes are sections of a wrapping material, such as paper, that is shaped into tubes or tube-shaped wrappers.

According to another advantageous feature of the invention, the production speed for compound filters can be noticeably increased by successively inserting individual portions of the filtering material, and/or inserting multiple portions, at least in part simultaneously. For the purpose of this invention, a multiple portion or multiple portions is or are understood to mean a packet or stack of at least two different or identical filtering materials, wherein at least two portions of the filtering material or materials is or are inserted during a single operational step into the filter tube. The filtering materials can comprise one, two or several granulated materials and soft filter elements such as filter plugs made of cellulose acetate, fleece, paper, non-woven material or hard elements, such as sintered elements, hollow cylinders or capsules. The filtering materials are advantageously inserted into the filter tube with a vertical movement component, and preferably an essentially vertical component. The filter tubes are thus preferably upright or completely vertical during insertion of the filtering material. Granulated material and gas-permeable limiting elements or end pieces are preferably inserted alternately.

In one preferred modification of the method according to the invention, the first part of the filter tube is initially filled essentially completely prior to rotation of the filter tube, so that the second part can also be filled essentially completely following the rotation. As a result of this preferred modification, the filter tube is essentially filled completely with filter elements or filtering material and thus can be conveyed for further processing. The filter wrapping material preferably has a hot-gluing seam on the inside, which is activated by supplying heat during the removal of the completely filled filter tube, thereby fixing the respective filtering materials inside the filter tube.

According to another preferred aspect of the invention, a compound filter with n segments is formed, wherein n is a natural, even number higher than 1.

According to yet a further aspect of the invention, compound filters are preferably produced by moving the filter tubes along a predetermined conveying path, along which the various operational steps are carried out. A corresponding movement path is preferably specified for this. The filter tubes preferably are moved at least in part cross-axially on the movement path.

One or more compound filters can be produced according to the above described processes. The compound filter produced in this way has, for example, 2-times, 4-times or 6-times the filter rod unit length, so that the compound filter, which contains different filtering materials, can be cut into 2, 4 or 6 corresponding filters of the unit length.

According to another preferred aspect of the invention, a pre-manufactured filter tube with filter element in the center is used to produce compound filters for tobacco products, such as cigarettes, cigars, etc., thus making it possible to considerably increase the production speed of a machine for producing compound filters. Filter tubes with a centrally positioned filter element or plug can be produced with a modified MULFI machine distributed by the assignee of the present application.

Corresponding filter tubes are preferably used for producing compound filters with n-times the unit length, wherein n represents an even, natural number above 1.

According to a modification of the invention, a filter tube for producing compound filters for products in the tobacco-processing industry is modified whereby the filter element arranged in the center of the filter tube is a tube-shaped wrapping material section. A machine producing compound filters is permitted a higher production speed using this embodiment of the filter tube according to the invention.

The filter element is preferably fixed essentially in one location, relative to the filter tube. It is advantageous if the filter element is glued to the filter tube, thus making it easier to secure it in one location. The filter element can have twice the unit length, for example between 4 and 16 mm. For each finished filter, half of this length (i.e. the unit length) remains with the corresponding cigarette.

The object of the invention is further achieved by a method for producing compound filters for products in the tobacco-processing industry, comprising: supplying a filter tube to a predetermined position; and inserting predetermined portions of filtering material into the filter tube, the inserting step including inserting at least two portions of the filtering material into the filter tube during one operational step.

For the purpose of the invention, at least two segments are essentially formed simultaneously in the filter tube. Thus, several segments are formed by transferring multiple portions of filtering material in one operational step. The filter tube preferably is filled completely during an insertion operation or always in double or triple portions, for which advantageously the bottom element is a soft element such as cellulose acetate, paper or the like, which is followed by a granulate and then a second soft element. A final operational step can preferably be carried out, during which preferably only one portion of a single type of filtering material is inserted into the filter tube.

It is advantageous if a filter tube is made available and/or produced during a first operating step. The filter tube is preferably filled exclusively from one side, thus permitting a simple design for a corresponding apparatus for producing compound filters for products in the tobacco-processing industry. If the filter tube is advantageously filled from both sides, the filling speed can be increased even further. For this, respectively one half is filled during one filling operation or during several filling operations, in which packets forming several segments are transferred.

The filter tube is preferably rotated, such that it can be filled from each end. The supplied filter tube thus advantageously has a filter element arranged in the center, meaning a pre-manufactured filter tube with filter element in the center is preferably used. In addition, the filter tube is advantageously conveyed, at least in part, cross-axially along a predetermined movement path. As a result, a quick process control and simple structural elements can be realized for a corresponding apparatus. The filtering material is furthermore advantageously inserted with a vertical movement component. Owing to this preferred embodiment of the invention, compact apparatuses or machines for manufacturing filters can be realized.

The filter tubes are advantageously formed during a preceding operational step and preferably consist of wrapping material sections formed into tubes or tube-shaped wrappers. Filtering material segments preferably are or will be formed, which alternately contain granulated material and gas-permeable end pieces, such as soft elements of cellulose acetate, paper or non-woven material or the like. A filter with n-unit lengths is preferably formed wherein n is a natural, even number above 1. A compound filter of n times the length is a filter with n times the usable length. Thus, we are here dealing with a multiple-unit filter with n times the usable length, wherein "multiple" stands for a plurality of segments of filtering material within the filter tube.

According to another aspect of the invention, a compound filter is advantageously produced according to one of the above-described methods.

According to still another aspect of the invention, there is provided an arrangement for manufacturing compound filters for products in the tobacco-processing industry, comprising: a filter tube feeding element; at least one conveying element into which filter tubes are deposited from the feeding element; and at least one processing station receiving the filter tubes from the conveying element and rotating the filter tubes. This embodiment according to the invention of a corresponding arrangement permits the filtering material feed elements to perform relatively short movements, so that the feed time can be shortened noticeably.

It should be understood herein that a processing station for the purpose of this invention is a station where filtering material is metered out, or a cutting operation takes place, or a filtering material is inserted into the filter tube and/or the like. Preferably, the tube itself is subjected to a vibration or is shook up during the feeding of the granulated material into the tube or shortly thereafter, so that the granulated material is packed as densely as possible. U.S. Pat. No. 3,603,058 to Schubert describes a vibration element that can be used for this purpose.

As discussed above, the filter tubes are preferably premanufactured wrapping material sections shaped into tubes which have a filter element arranged in the center of the respective section. According to one preferred embodiment of the invention, a particularly simple and compact arrangement results if the at least one conveying element is at least one continuously circulating conveyor for cross-axially conveying of the filter tubes. Furthermore, a particularly compact design is obtained if the at least one processing station is arranged on a single conveyor.

According to a further aspect of the invention, a highly modular design of the arrangement is provided if at least one processing station is advantageously assigned to some of the conveyors, that is, in particular to a specific number of conveyors, while no processing station is assigned to other conveyors. With a modular arrangement of this type, different filter specifications can be considered relatively quickly and a corresponding changeover or new adjustment can be effected. A maximum of one processing station is advantageously assigned to each conveyor. This preferred embodiment of the arrangement according to the invention results in a highly modular design for the arrangement.

It is additionally preferable if at least one filtering material feed station, at least one filtering material insertion station, at least one removal station and/or at least one heating station are provided as processing stations. The filtering material is moved with the filtering material feed station to the area of the filtering material insertion station or flows as a result of gravity into the filter tube. The removal station removes finished or completely or partially filled filter tubes. The heating station preferably functions to activate the hot glue for securing the filter elements inside the filter tube. A cutting station comprising, for example a circular blade, can furthermore be provided as one of the processing stations.

An exact metering out of granulate, for example, is possible if the at least one filtering material feed station advantageously contains two rotating discs, respectively provided with bores, and arranged off-center from one another. The bores in the one disc and the bores in the other disc become aligned at one location. The portions are determined, for example, by the bore size or by an additional metering element.

According to another embodiment of the invention, a secure filling of the filter tube occurs if the at least one filtering material feed station includes at least one sliding element containing bores and/or at least one lever element with bores. The filter tubes can be filled safely if the at least one filtering material insertion station advantageously comprises at least one first transfer means for inserting the filtering material into the filter tubes. It is advantageous if at least one second transfer means is provided, which functions from the opposite end of the filter tube as a counter support to the at least one first transfer means for allowing the filter tube to be filled simultaneously from both ends. Alternatively, the second transfer means can be used to hold the filter element in the center of the filter tube, or for placing the filter tube in the filtering material insertion position. At least one filter tube is advantageously arranged such that it is axially aligned with at least one bore. Furthermore, at least two bores are advantageously arranged axially aligned with the filter tube. In this case, several filtering material portions can be transferred simultaneously, thus making it possible to achieve an even higher production speed.

According to still a further aspect of the invention there is provided a compound filter-manufacturing system for products in the tobacco-processing industry, comprising a filter tube feed machine; a conveying system for transporting the filter tubes along a predetermined movement path; and a device for rotating the filter tubes installed on the convening system. In particular, this should be understood to mean that the conveying system comprises a device for rotating the filter tubes. A compound filter-manufacturing system thus constructed advantageously permits a rapid filling of the tubes with filtering material.

The conveying system preferably comprises at least one continuously rotating conveyor for the cross-axial conveying of the filter tubes. Furthermore, at least one processing station is advantageously provided, which is assigned to at least one conveying element. A very compact system for producing compound filters is made possible if only a single conveyor is advantageously provided, to which at least one processing station is assigned. Furthermore, a modular compound filter-manufacturing system is made possible if several conveyors are advantageously provided, to which at least one processing station or no processing station is assigned. A highly modular compound filter-manufacturing system is obtained if several conveyors are preferably provided, with at most one processing station being assigned to each conveyor.

According to another aspect of the invention, there is provided apparatus for producing compound filters for products in the tobacco-processing industry, comprising: a filter-tube feeding element; at least one conveying element into which filter tubes are insertable from the feeding element; and at least one processing station for being supplied with the filter tubes by the at least one conveying element, wherein at least one of the processing stations is a filtering materials insertion station including means for inserting two portions of filtering materials into a filter tube in a single operational step.

In the event that the portions are inserted into more than one filter tube in the processing station, it is advantageous if respectively two portions can be inserted. This embodiment according to the invention of the apparatus for producing compound filters makes it possible to achieve an extremely fast processing speed.

Preferably, a device for rotating the filter tube is provided as a processing station. The filling operation can occur even faster as a result of this embodiment of the invention since the movement that must be carried out by the feeding and filling elements can be relatively short.

It is advantageous if the at least one conveying element is at least one continuously circulating conveyor, which transports the filter tubes cross-axially. An extremely compact apparatus can be realized if the at least one processing station is advantageously arranged on a single conveyor. A modular configuration is possible if at least one processing station is assigned to the conveyors. A highly modular design results if maximally one processing station is assigned to each conveyors. Several conveyors are preferably provided, at least one of which is assigned to at least one processing station and at least one of which is assigned to only one processing station. A good compromise between having a compact apparatus and sufficient modularity is achieved with this preferred embodiment of the invention.

According to one feature of this aspect of the invention, one filtering material feed station is advantageously provided, wherein this station comprises two rotating and eccentrically arranged discs that are respectively provided with bores. The bores in the one disc and the bores in the other disc are arranged so that they are aligned in one location. An exact metering out of the filter granulate, for example, is possible with this filtering material feed station.

At least one filtering material feed station is preferably provided, wherein this station comprises at least one pusher element containing bores and/or at least one lever element provided with bores. The filtering material can be handled easily and quickly with this filtering material feed station. The aforementioned two filtering material feed stations preferably are combined to form a single filtering material feed station, for which different feeding methods can be used.

The apparatus according to the invention can be realized particularly easily if a filtering material insertion station is provided, which comprises at least a first transfer means, in particular at least one pusher, for inserting at least two portions of the filtering material during one operational step into the filter tube. The filtering material insertion station preferably can overlap with a filtering material feed station.

A second transfer means is advantageously provided, which serves as a counter support to the at least one first transfer means from the opposite side of the filter tube. The transfer means itself furthermore can, but does not have to, insert filtering material into the filter tube.

At least one filter tube is preferably arranged axially aligned with at least two bores.

The object of the invention is furthermore accomplished with a multiple-unit length filter-manufacturing system for products in the tobacco-processing industry, comprising a filter-tube feeding device and a system for transporting the filter tubes along a predetermined movement path, as well as at least one processing station. The system is modified in such a way that in the at least one processing station, at least two portions of the filtering material can be inserted during a single processing step into at least one filter tube.

Insofar as filtering material portions are or must be inserted into several filter tubes, at least two portions of the filtering materials preferably are inserted or must be inserted. The filter-manufacturing system may be advantageously modified with a device for rotating the filter tubes, which device functions as a processing station. A particularly fast operation is possible with this preferred embodiment of the filter-manufacturing system. The filter-manufacturing system can be realized especially easily if the transport system preferably comprises a continuously circulating conveyor, which conveys the filter tubes cross-axially.

According to a particularly favorable embodiment, a modular design is feasible if the at least one processing station is assigned to at least one conveyor. An extremely compact filter-manufacturing system is obtained if a single conveyor is provided, to which at least one processing station is assigned. A highly modular design of the system is possible if several conveyors are provided, which are each assigned to no more than one processing station.

The machine or system for producing compound filters for products in the tobacco-processing industry currently manufactured and marketed by the assignee of the present application produces approximately 1,200 compound filters with twice the unit length. The method and arrangement according to the invention advantageously permits the production of 5,000 compound filters with twice the unit length, thus achieving the object of the invention as first described above.

BRIEF DESCRIPTION OF THE DRAWINGS

The foregoing and other features and advantages of the invention will be further understood from the following detailed description of the preferred embodiments with reference to the accompanying drawings.

FIG. 10*a* shows a granulated material feed element in a view from above and FIG. 10*b* shows a view from the side of FIG. 10*a*.

FIG. 14*a* shows a schematic representation of a filter-manufacturing machine with modular design for producing triple filters configured as shown in FIG. 14*b*.

FIG. 14*b* shows a triple filter with twice the unit length made by the machine illustrated in FIG. 14*a*.

FIG. 17 shows a schematic view from the side of an exemplary embodiment of functional elements for feeding filtering material and removing multi-segment or compound filters.

FIG. 18 shows a schematic representation of the filter elements during the processing according to FIG. 17.

DETAILED DESCRIPTION OF THE PREFERRED EMBODIMENTS

In the following detailed description of the invention, like elements or features in the respective figures are identified by the same reference numbers so that the same elements or features do not have to be introduced anew each time.

Figure 1:
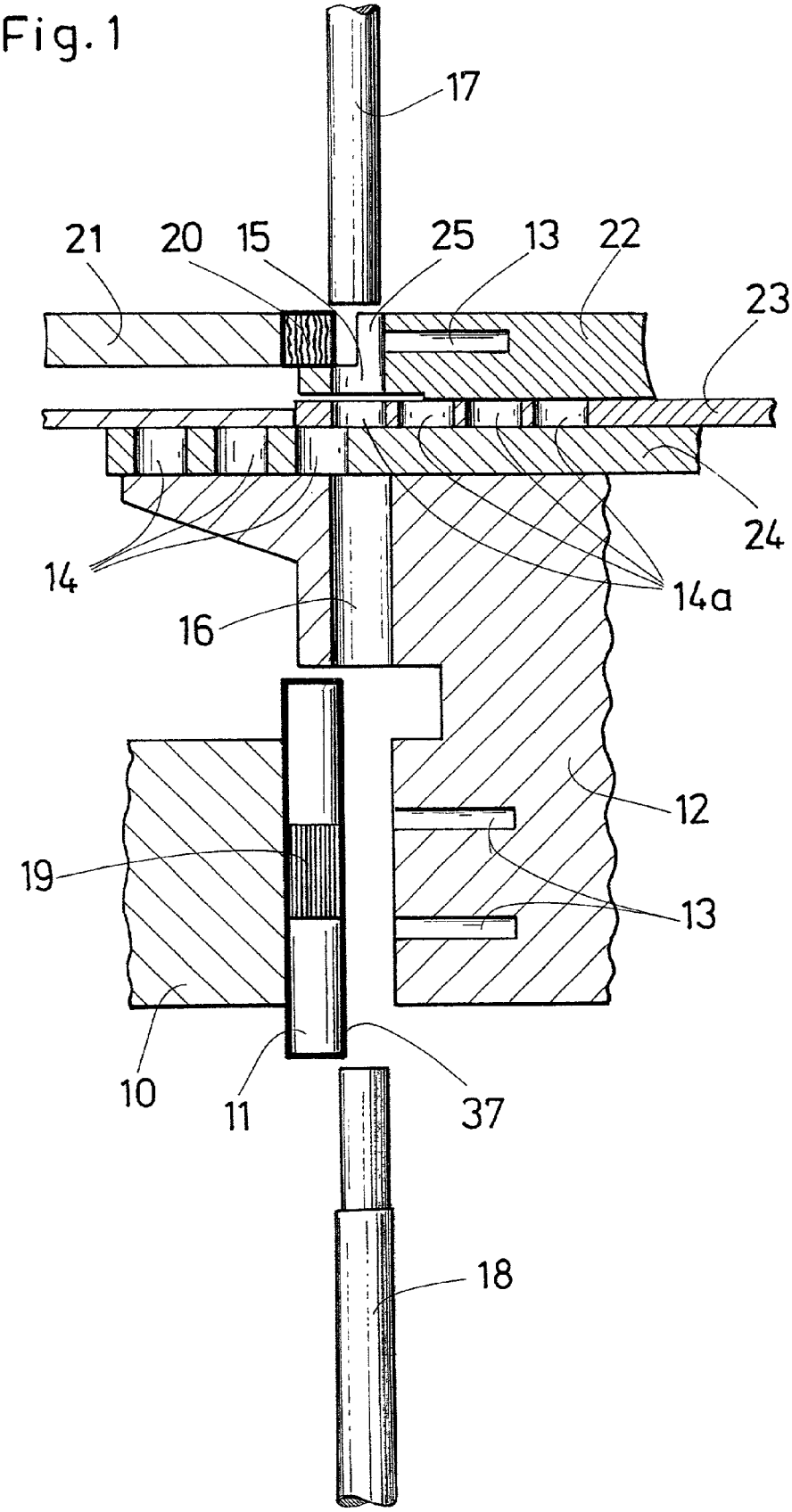
FIG. 1 shows a sectional representation of a transfer station during a first operational stage.

Referring to FIG. 1 there is shown a cross-sectional representation of a transfer station according to the invention. A tube 11 with a centrally arranged filter element 19 is positioned in a depression in a tube feeding cylinder 10 and is moved to a region of a transfer station. Similarly, a filter plug 20, that may consist of cellulose acetate and has a length of, for example, 8 mm, is supplied to a plug receptacle 25 by a filter plug conveyor 21, which may comprise a filter plug cylinder that accommodates the corresponding filter plugs 20 inside receptacles.

Figure 2:
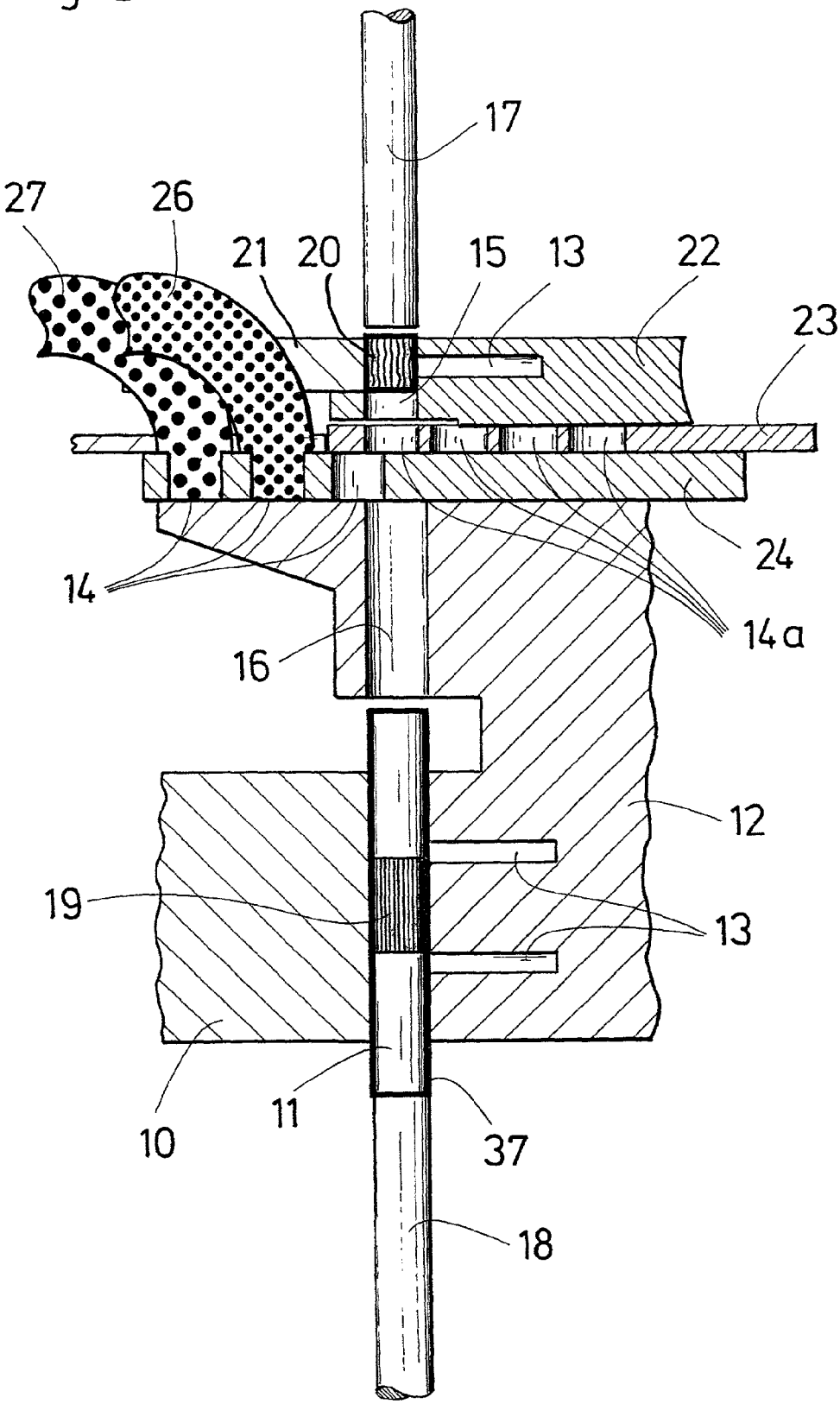
FIG. 2 shows the transfer station shown in FIG. 1 during a further operational stage.

During one continuous operational step, shown in FIG. 2, the filter tube 11 makes contact with the transfer station and is held in the specified position by vacuum bores 13, arranged on a conveying cylinder 12. Furthermore, a push rod 18 is shown already inserted from the bottom into the filter tube 11. The plug 20, which is conveyed by the filter plug conveyor 21, has been transferred to the transfer unit and is held with the aid of another vacuum bore 13 in conveyor 22 in the position indicated in FIG. 2. Two different granulate materials, namely a first granulate 26 and a second granulate 27, are furthermore filled into bores 14 of a pusher 24. The amount of granulate is predetermined by the bore size. The pusher 24 in the drawing plane is designed to slide from the left to the right and vice versa.

Figure 3:
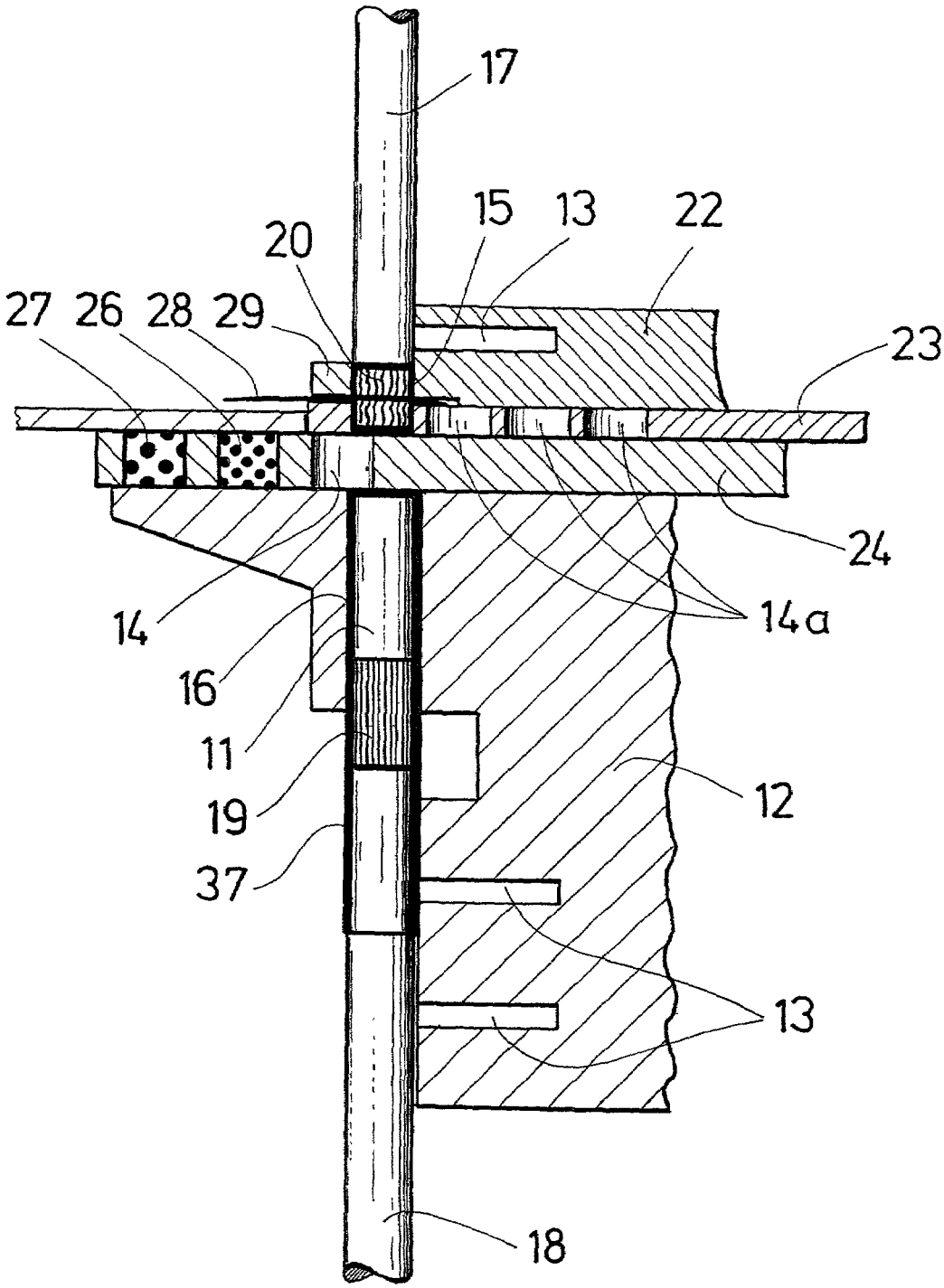
FIG. 3 to FIG. 8 show the transfer station, represented in FIGS. 1 and 2, during successive stages of the operation.

FIG. 3 shows a cross-sectional representation of the transfer station, wherein the push rod 18 is moved further upward in vertical direction, so that the upper end of tube 11 is essentially aligned with the upper edge of the conveying cylinder 12. The push rod 17 then moves the plug 20 in the axial direction vertically downward into the pipe 15 and a first bore 14*a* of a pusher 23. At exactly the upper edge of the pusher 23, a circular blade 28 is guided inside a guide 29 and cuts the plug 20 into two identical plugs, measuring 4 mm each. The vacuum or suction air in the vacuum bores 13 is turned off to move the plug 20 into the pipe 15 and the tube 11 into the conveying cylinder bore 16.

Figure 4:
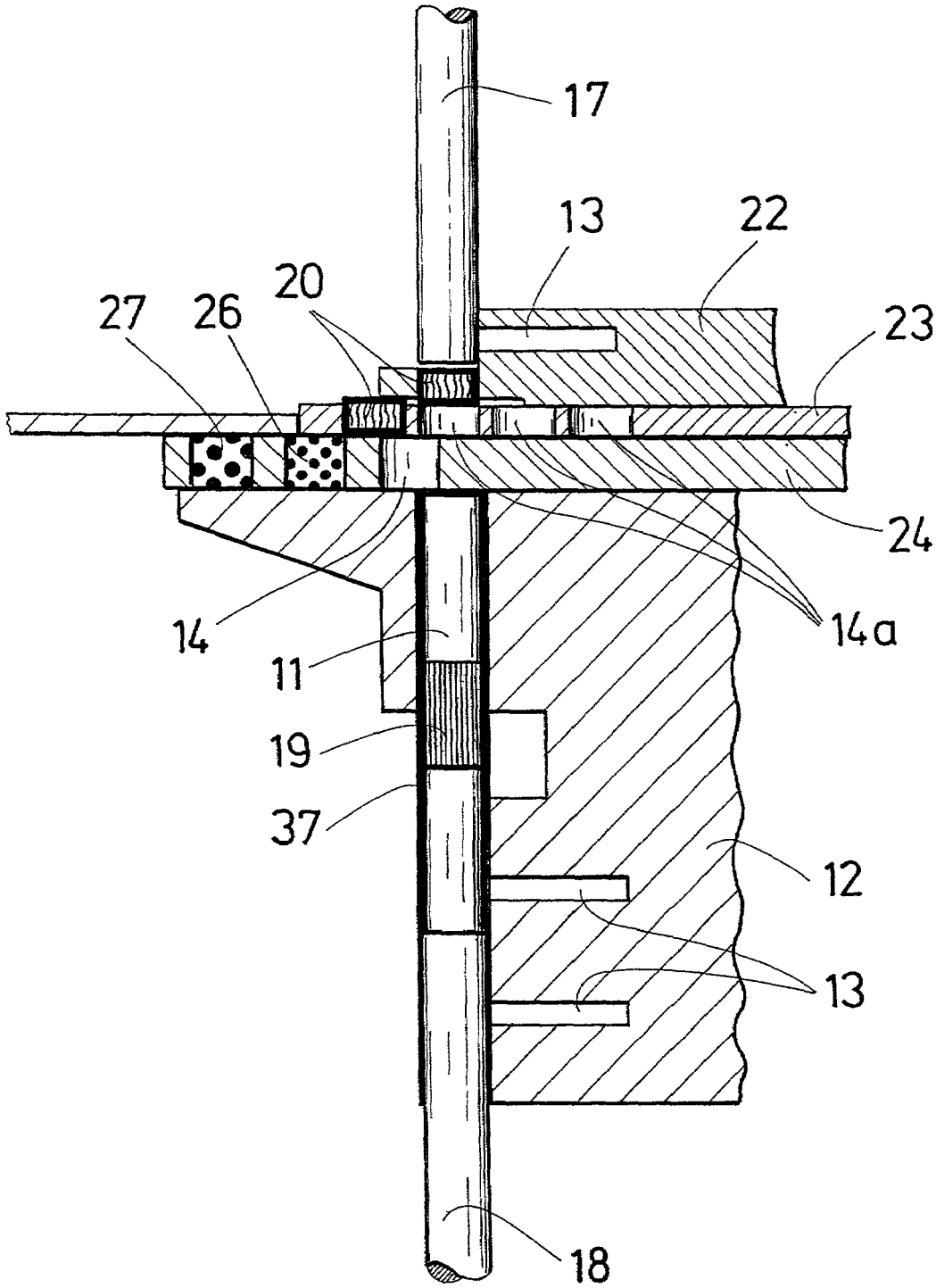

During a subsequent operational step, shown in FIG. 4, the pusher 23 is moved to the left, so that the upper portion of the divided plug 20 is vertically aligned with another bore 14 of pusher 23. In another operational step, not shown herein, the plug 20 is moved with push rod 17 into another bore 14*a* of slide 23 and an additional filter plug 30 is supplied, consisting of a different material such as fleece enriched with a granulate. This filter plug is then cut with a circular blade and inserted into the remaining two bores 14*a* of pusher 23, as shown in FIG. 5 which shows the precise operational state in which the additional filter plugs 30 are inserted into the remaining bores of slide 23.

Figure 5:
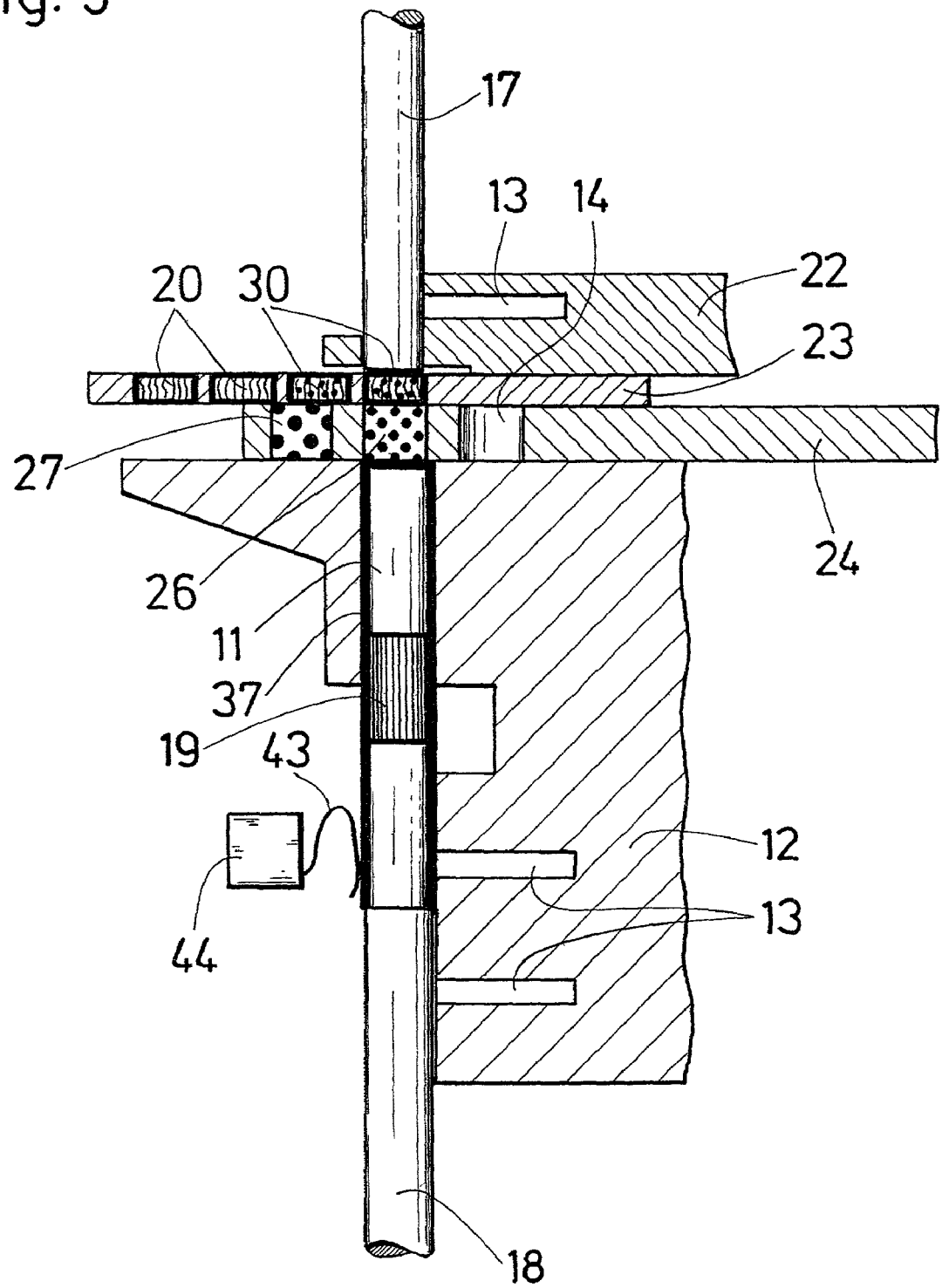
Figure 6:
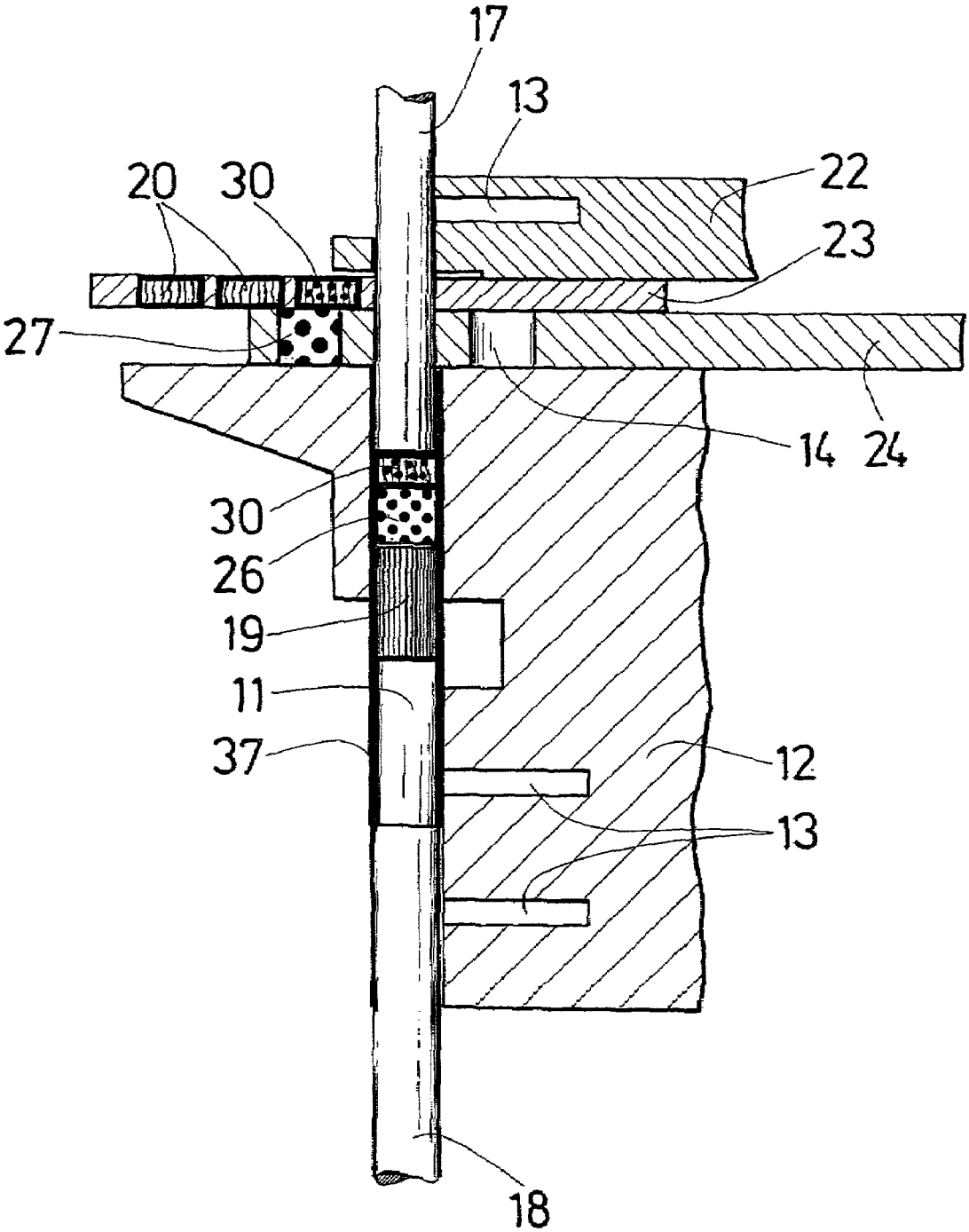

Referring to FIGS. 5 and 6, the $1^{st}$ granulate 26 drops under the effect of gravity into the tube 11. An oscillator 44, which excites oscillations in a spring plate 43 causes the tube 11 to oscillate or vibrate to achieve the highest filling density. These oscillations are transmitted to the tube 11 through mechanical contact between the spring plate 43 and the tube 11.

According to FIG. 5, a bore 14*a* in the pusher 23, containing a filter plug 30, and a bore 14 in the pusher 24 that holds granulate are furthermore aligned with the conveying cylinder bore 16 or the tube 11. As a result, the push rod 17 can insert the filtering material 30 and 26 into the tube 11 during a following operational step that is shown in FIG. 6. Contrary to what is shown in FIG. 6, the filtering material 30 and 26 can be filled to reach only the upper edge of the filter tube 11, so that the degree of movement of the push rod 17 can be further minimized.

Figure 7:
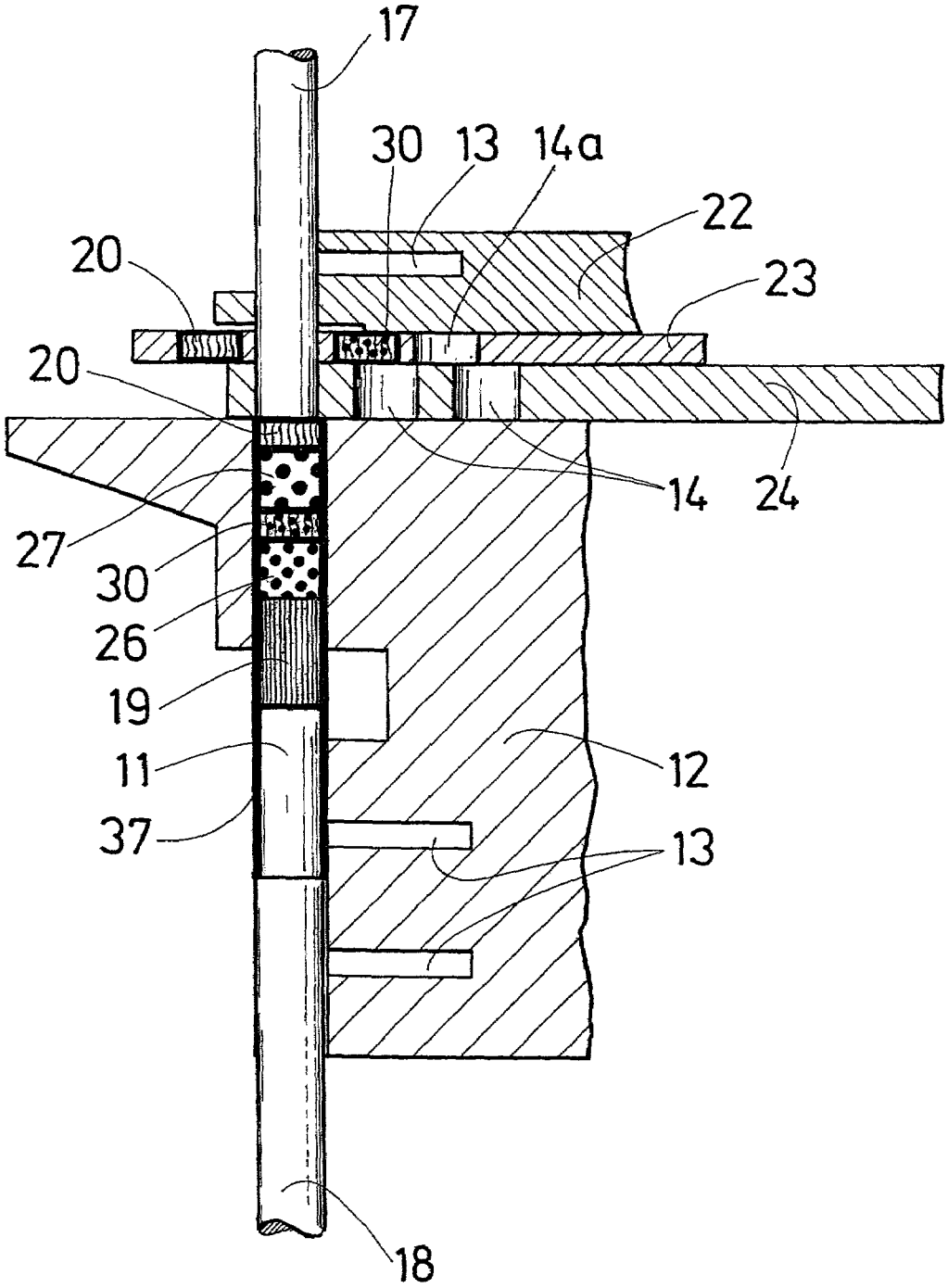

FIG. 7 shows an operational state where, following a corresponding alignment of a bore 14*a* of pusher 23 with therein arranged filter plug 20 and a bore 14 of pusher 24 that contains the granulate 27, with the tube 11, the push rod 17 inserts the material into the end of tube 11.

Figure 8:
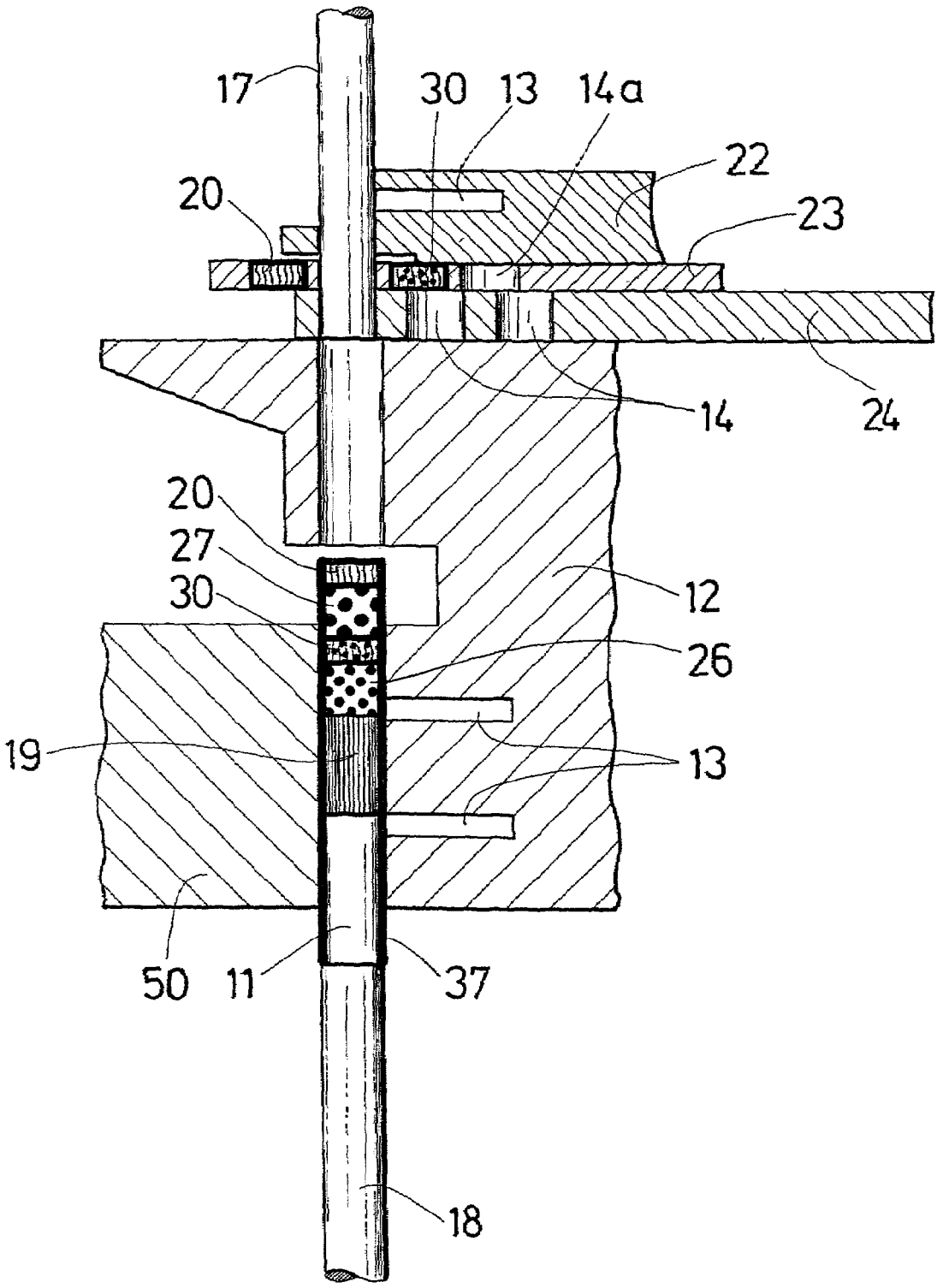

FIG. 8 shows the operational stage in which the tube 11 that is filled halfway with filtering material is moved downward by lowering the push rod 18 back to the effective range of the vacuum bore 13, so that the tube 11 is again held against these vacuum bores and, correspondingly, is held in the receptacles provided in the conveying cylinder 12. During the next step, the half-filled tube is supplied to a rotating cylinder, so that the tube 11 is rotated by 180° and subjected to the same operational steps described above for filling the tube from the other end so that a filter with on the whole twice the unit length can be produced. For this exemplary embodiment, the filter with two times the unit length comprises five different filtering materials, arranged in segments inside the filter. The filtering materials comprise a first filtering material 19, e.g. with a length of 8 mm after the filter with twice the unit length is cut, a first granulate 26 with a height of approximately 8 mm, a second filter plug 30 that is approximately 4 mm high or 4 mm thick, a second granulate 27 with a height of approximately 8 mm and a final filter plug 20 with a thickness of 4 mm. Within the framework of this invention, filter plugs ranging down to a thickness of 2 mm can also be used, so that even more filtering materials can be arranged in segments inside the tube 11.

Finally, FIG. 8 shows a removal cylinder 50 that removes the half-filled tube 11 to a rotating cylinder, not shown in FIG. 8. In this rotating cylinder, the tube 11 is subsequently rotated by 180° and is then again supplied by a feed cylinder to the conveying cylinder 12 for filling up the rest of the tube 11.

For the purpose of this invention, it is also possible to rotate the tubes several times in order to insert different filtering materials at several stations. It is therefore not necessary for each half of the tube 11 to be filled completely at one transfer station before it is rotated.

The Mulfi E machine distributed by the assignee of the present application, for example, can be adjusted correspondingly to produce the tubes 11 with a first filtering material 19 arranged in the center. For example, in order to glue in the later inserted filter plugs, the hot-melt glue used for gluing together the seam of tube 11 is replaced with PVA glue (polyvinyl acetate glue). For this, the cooling bar that glues the seam together is replaced with a heating bar and the glue supply replaced accordingly. The filter tube is thus glued together with glue that does not lead to a separation of the glued connection when it is subjected to heat.

The subsequently inserted filter segments are glued in by applying a hot-melting glue strip to the paper on the tube inside, before the tube is formed. Following the insertion of the filter segments into the tube with a cooled-down hot-melting glue track, the complete tube is heated either with contact heat or a corresponding, energy-rich radiation, e.g. microwave radiation. As a result, the hot-melt glue is melted and the segments are glued together.

Figure 9:
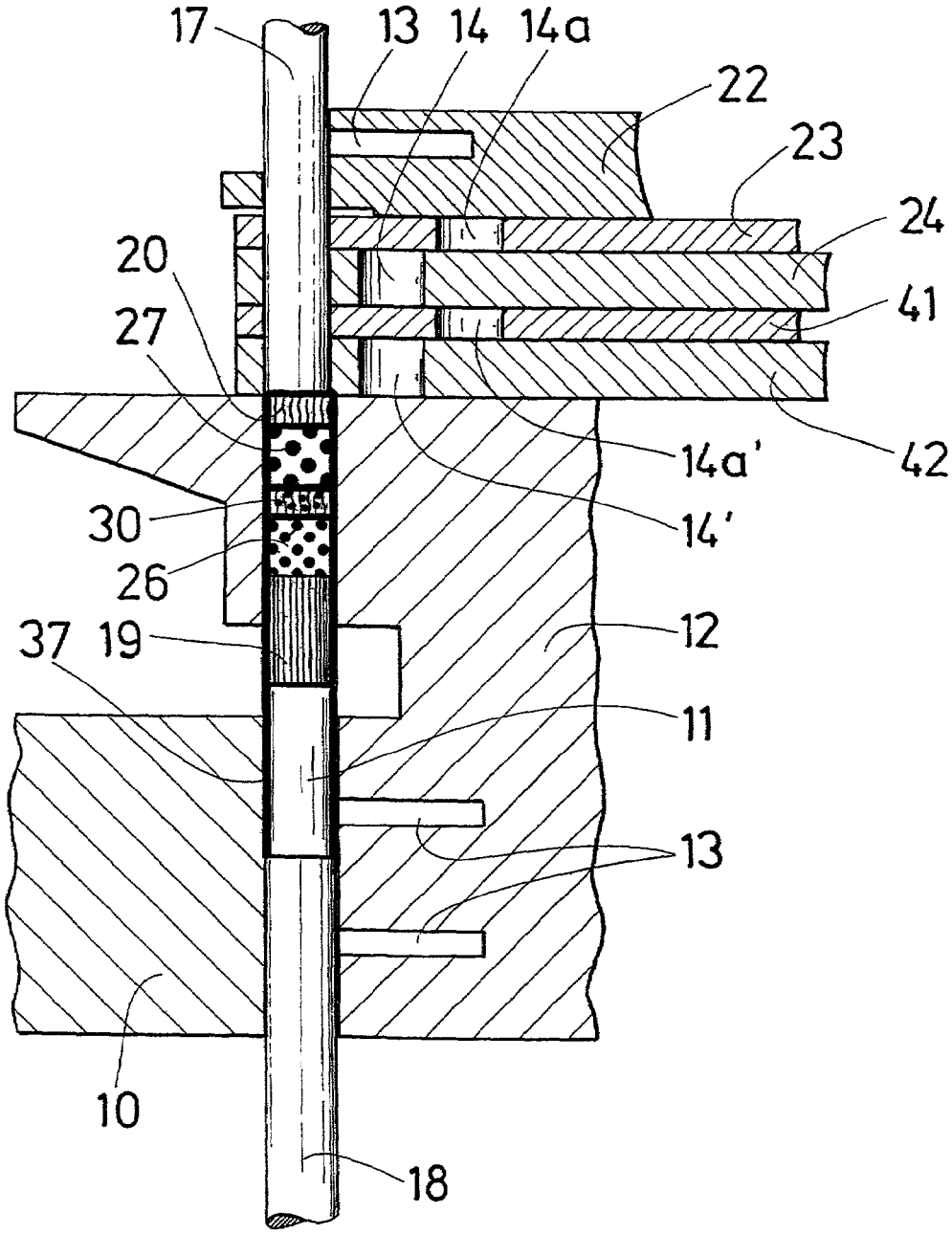
FIG. 9 shows another embodiment according to the invention of a transfer station.

FIG. 9 shows another embodiment according to the invention of an arrangement for transferring four different filtering materials simultaneously to the tube. The tube otherwise consists, for example, of a paper tube 37. To be able to transfer four different materials, a third pusher 41 having bores 14*a*' and a fourth pusher 42 having bores 14' are provided in addition to the first pusher 23 and the second pusher 24. A soft element 30 is inserted, for example, into the third pusher 41 and a granulate 26 is filled into the fourth pusher 42.

For the purpose of this invention, it is also possible to increase to four the number of bores in the pusher 24, shown in the examples in FIGS. 1 to 8. Thus, four bores are filled with corresponding granulate and no further granulate must be filled in after the filter tube is turned or rotated. According to the embodiments shown in FIGS. 1 to 8, corresponding filter plugs 20 and 30 are stored and ready, so that no additional filter plugs must be inserted into the pusher 23 after one side of the tube 11 is filled. The same is also possible with the exemplary embodiment shown in FIG. 9.

FIG. 10*a* shows a cross-sectional view from the side of a preferred granulate feeding station or a granulate portioning station. Two discs, namely a first disc 31 and a second disc 32, are arranged off-center, with the first disc 31 being arranged above the second disc 32. FIG. 10*b* shows the arrangement in FIG. 10*a* in a view from above. Both discs 31 and 32 are provided with bores 14. These bores are filled with granulate 26 from a granulate filling device 51.

The first disc 31 rotates counter-clockwise above the disc 32, which also rotates counter-clockwise for this exemplary embodiment. Tubes 11 are arranged below the second disc 32 and are held by means of standard holding elements at the respective locations. The portioned granulate, predetermined by the size of the bores, moves counter-clockwise in the direction of an insertion zone 38*a*–38*b*. The filter tubes 11 arranged below the second disc 32 move in the same way. The bores of both discs are aligned at the insertion position 38. FIG. 10*b* shows that granulate flows into the tubes under the effect of gravity. As a result of this preferred granulate feed station or portioning station according to the invention, it is particularly easy to realize the portioning of granulate and the filling of the granulate into the filter tubes. Owing to the large insertion zone 38*a*–38*b*, the discs 32 and 31 can rotate with increased speed, thus increasing the production speed accordingly. An oscillator 44 and a spring plate 43 are furthermore provided for this embodiment to achieve the densest possible granulate filling by exciting vibrations in the tube 11 following the filling with granulate 26. The oscillator 44 preferably comprises an electromagnet having a mass that oscillates back and forth with a frequency of 50 Hz.

Figure 11:
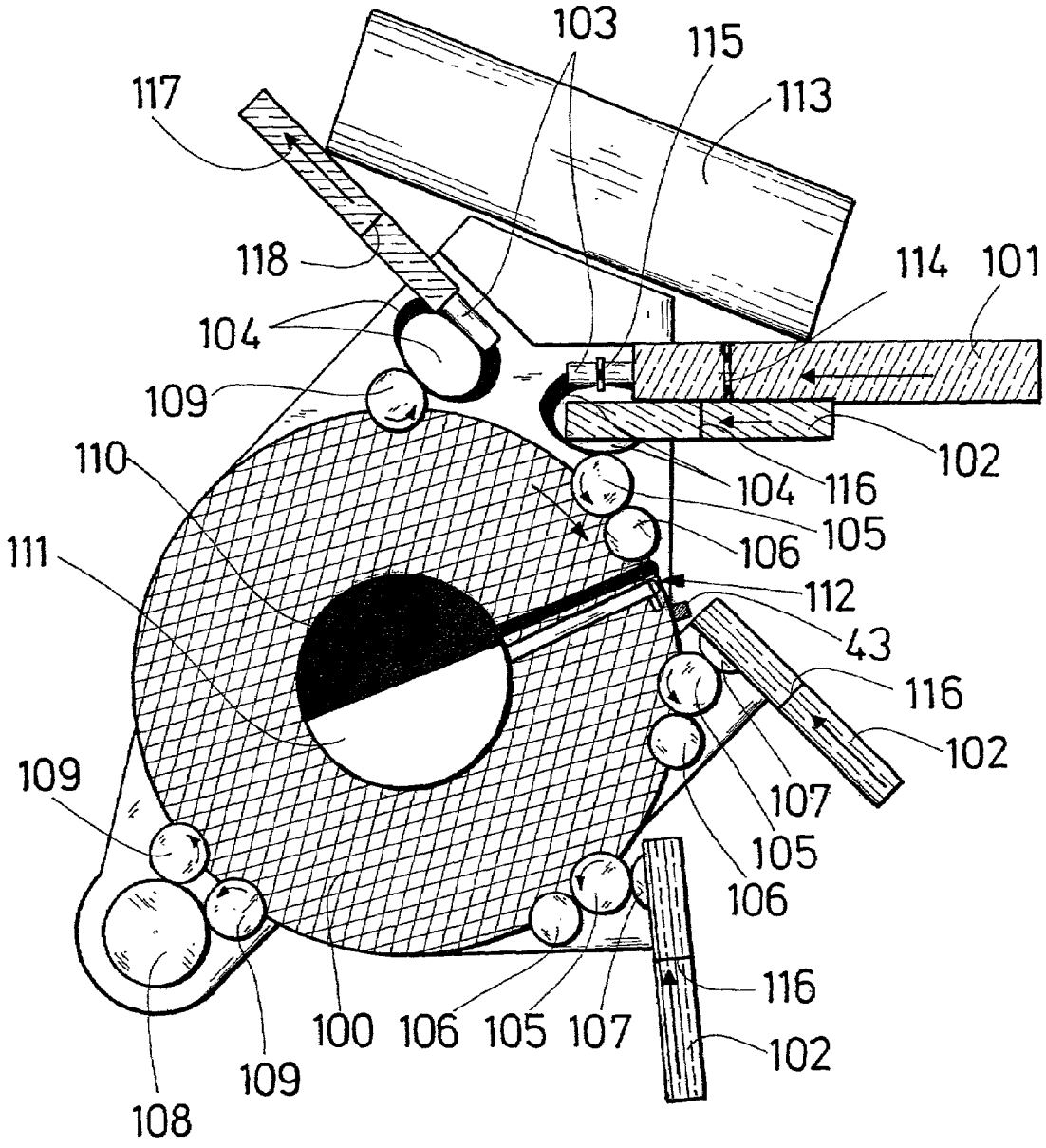
FIG. 11 shows a schematic representation of a filter-manufacturing machine in a view from above.

FIG. 11 shows a schematic view from above of a filter-manufacturing machine. The processing stations which are provided according to FIGS. 1 to 9 for inserting the filter elements are not shown in FIG. 11.

As shown in FIG. 11, a single main cylinder 100 is used for carrying out the various processing steps. A tube mass flow of tubes 101 guides the tubes 114 with 4-times the unit length to the filter-manufacturing machine. The filter tubes with 4-times the unit length are cut in the center and are moved axially in the region of a transfer cylinder 103, which is not shown herein. The tubes are fed with the aid of a cone-shaped transfer cylinder 104 and a transfer cylinder 105, e.g. corresponding to the filter feed cylinder 10 in FIG. 1, to the main cylinder 100. The main cylinder corresponds, for example, to the conveying cylinder 12 shown in FIG. 1.

A filter element mass flow 102 guides filter elements with 12-times the unit length to the filter-manufacturing machine where they are cut into shorter segments at a location not completely shown herein. The filter elements or the cut filter elements 116 are supplied with a cone-shaped transfer cylinder 104, for example, corresponding to the plug conveyor 21 shown in FIG. 1, to a transfer cylinder 105, where they are divided further with a circular blade 106. The filter-manufacturing machine has three components that can be used to feed filter elements with a respective length, but which may have different characteristics. Cone-shaped transfer cylinders 107 for transferring the filter elements are also shown for the filter element feed stations, arranged below.

A first storage container and a second storage container are provided for a first granulate 110 and a second granulate 111. The granulates are supplied with corresponding conveying elements to a granulate transfer station 112 for filling corresponding bores in pushers completely with the desired granulate. The main cylinder 100 moves clockwise. Before the main cylinder 100 has completed half of a complete rotation, one side of a compound filter with twice the unit length is filled completely. This half-filled compound filter is moved with a transfer cylinder 109 to a rotating cylinder 108 where it is rotated and is supplied once more to the main cylinder 100 with the aid of another transfer cylinder 109. The rotating cylinder 108 is described, for example, in German Patent No. 199 20 760 owned by the assignee of the present application, wherein an arrangement is disclosed for rotating rod-shaped articles with a rotating cylinder. The rotating cylinder accommodates the rod-shaped articles to be rotated in receptacles and is provided with at least one section for rotating at least two rod-shaped articles parallel to each other.

All other filling operations occur during the remaining rotation of the main cylinder 100, although the additional filling elements are not shown in FIG. 11. Just before the main cylinder 100 completes a full rotation, the completely or partially filled compound filter tubes or compound filters with twice the unit length are transferred by a transfer cylinder 109 and corresponding cone-shaped transfer cylinders 104, as well as a transfer cylinder 103, to a double compound filter mass flow 117, wherein the compound filters 118 shown therein have twice the unit length. A switch cabinet 113 controls the filter-manufacturing machine. A single main cylinder 100 is shown for this embodiment of the invention, in which all operational steps for filling the filter tubes 11 can be carried out. Just prior to removal of the completely filled tubes, a heating element can be provided and can be brought in contact with the respective tubes. This heating element is designed to melt hot-melting glue, applied during a previous operational step to the inside of the paper tube, so that the inserted filter materials are glued in place in their positions. FIG. 11 also shows the spring plate 43, which functions to transfer vibrations to the granulate-filled tube.

Figure 13:
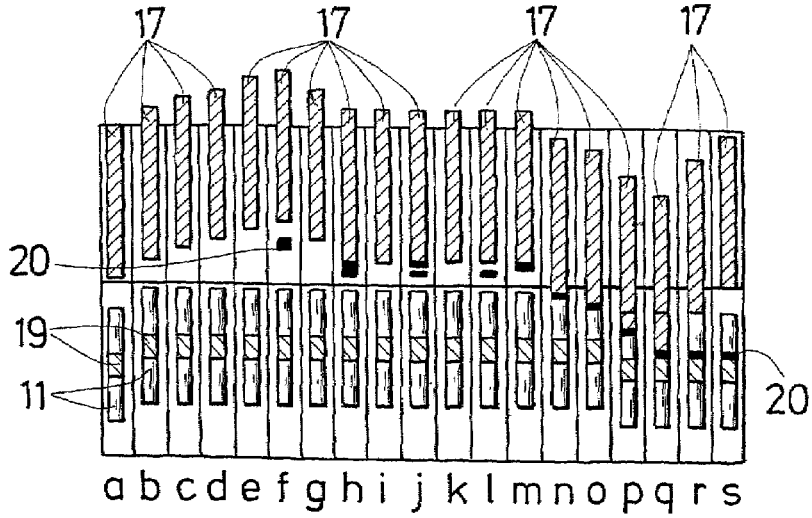
FIG. 13 schematically shows the respective arrangement or position of a filter tube and a filter element, as well as a corresponding push rod during successive operational steps of the machine shown in FIG. 12.
Figure 12:
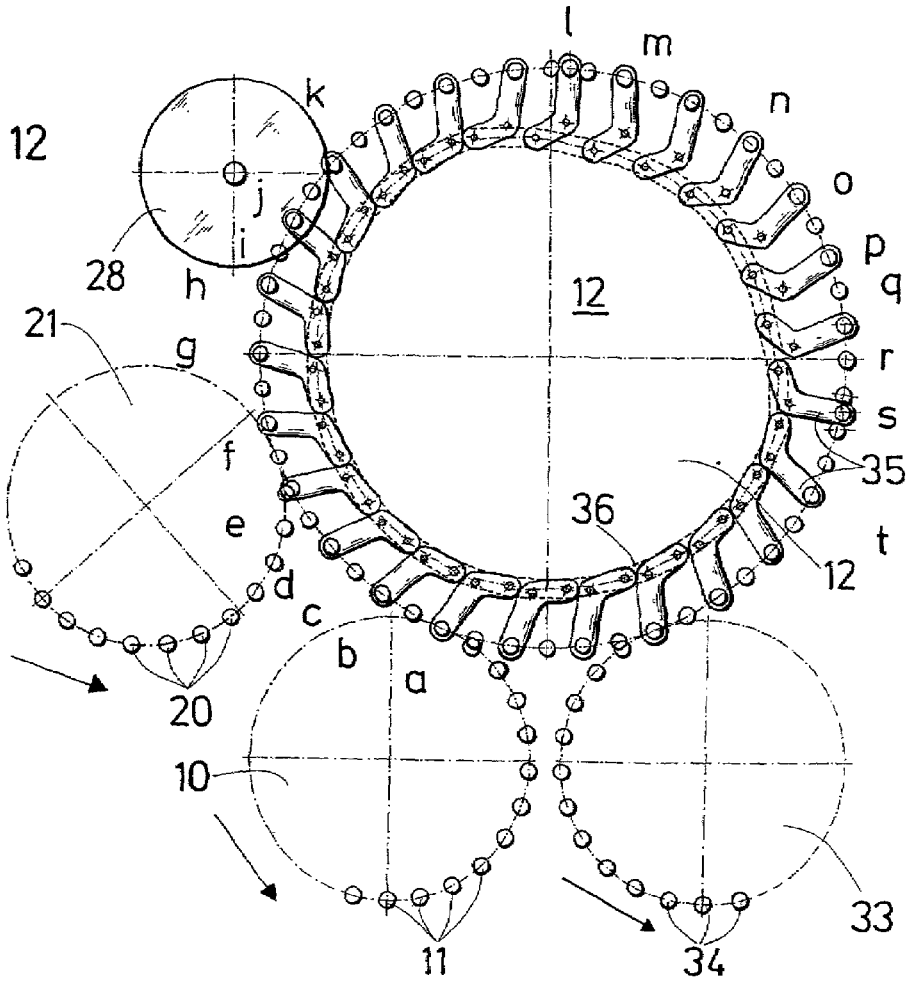
FIG. 12 shows a schematic view from above of the elements for a modified embodiment of a filter-manufacturing machine.

FIGS. 12 and 13 show a schematic representation of another embodiment of the invention. Filter tubes 11 are supplied with a tube-feeding cylinder 10 to a conveying cylinder 12. This is also shown schematically with position "a" in FIG. 13. At position "b," the tube 11 and also the push rod 17 are moved further toward the top. At position "e," the push rod is moved up even further. At position "f," the filter plugs 20 are supplied with a filter plug conveyor 21, which is a cylinder for this exemplary embodiment. This is also shown schematically at position "f" in FIG. 13.

The schematic "f" to "m" in FIG. 13 show adjacent tubes and push rods. Thus, positions "f" and "g" should be viewed jointly in the schematic representation in FIG. 13. The push rods 17 are moved downward in the following operational steps "h" and "i", thus causing the filter plug 20 located at position "h" to move down as well. The filter plug 20 is divided at positions "j" and "k" into two parts, with a circular blade 28. The upper portion of plug 20 is located inside a receptacle or a bore in a lever 35. At positions "l" and "m," the lever 35 is pivoted, so that its bore is aligned with the bore of the main cylinder or the conveying cylinder 12, located underneath, which accommodates the tube 11. From then on, the operational steps are once more shown individually. At positions "n" to "q," the push rod 17 moves into the opening in which the tube 11 is located and inserts the respective filtering material into this tube. At "r" and "s," the push rod 17 is again pulled out of this opening. At "t," the lever returns to its starting position. The partially filled tubes 11 are then removed with the removal cylinder 33, which holds the filter tubes with filter elements 34 disposed inside receptacles. For the purpose of this invention or this exemplary embodiment, one half of the tube 11 can also be filled completely. FIGS. 12 and 13 show only the variant of a lever instead of a pusher for moving the respective filter plugs. It is also possible to move several levers 35, into which granulate can be filled, for example, or a combination unit consisting of levers and pushers.

FIG. 14*a* shows a modular design for a filter-manufacturing machine. Shown are the tube-feeding module 130, two granulate and soft element filling modules 131 and 131', and the rotating module 132. For this exemplary embodiment, tubes are supplied via a tube pallet 120 and filter elements are supplied with two filter element pallets 121 and 121'. The tube-feeding module 130 feeds tubes from the tube pallet 120, a takeover cylinder 123 and a transfer cylinder 124. The transfer cylinder 124 conveys the tubes from the takeover cylinder 123 to a removal cylinder 125, which in turn conveys the tubes to a granulate cylinder 126. Once they arrive at the granulate cylinder 126, the tubes are filled with granulate, for example using a device as shown in FIG. 10. The tubes that are partially filled with granulate are then transferred to a lever cylinder 127, which may have a design as shown in FIG. 12. In this module, namely the granulate and soft element filling module 131, filter elements are supplied from a filter element pallet 121 via a further takeover cylinder 123' and a supply and tube takeover cylinder 128 to the lever cylinder 127.

The tubes filled with granulate and corresponding filter elements, such as soft elements, one side of which is now filled completely for this embodiment, are removed by the feed and tube-takeover cylinder 128 and are transferred to a transfer cylinder 124' which is arranged in the rotating module 132. The transfer cylinder 124' transfers the half-filled tubes 11 to a rotating cylinder 129, in which the tubes are rotated. On the way to the rotating cylinder, the tubes can be subjected to heat for activating a hot glue strip, which fixates the filter elements. After the tubes are rotated, the half-filled tubes are transferred to the other granulate and soft element filling module 131' with the aid of a removal cylinder 125', which turns the tubes over to a granulate cylinder 126' in which the tubes are filled again with granulate. Following this, the tubes are turned over to a lever cylinder 127' where they are filled with an additional soft element. The soft elements in this case are transferred from the filter element pallet 121' via another takeover cylinder 123" and a feed and tube takeover cylinder 128' to the lever cylinder 127'. The tubes, which are now completely filled, are then moved via the cylinder 128' to another transfer cylinder 124" with heating station 39, which serves to activate a hot glue completely or in the remaining portion of the tube.

FIG. 14*b* shows a cross-sectional view of a completely filled double compound filter 118. This filter consists of a first filter element 19, granulate 26 and respectively one filter plug 20. During the subsequent cigarette production, this double unit length compound filter is cut in the center of the first filter element 19.

Figures 15A, 15B:
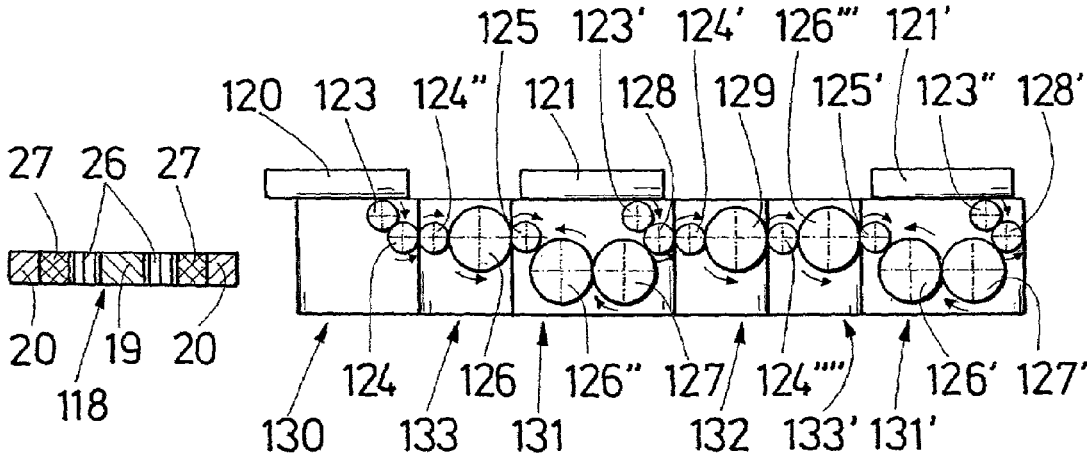
FIG. 15*a* shows a schematic representation of a machine for producing quadruple filters configured as shown in FIG. 15*b*.
FIG. 15*b* shows a quadruple filter with twice the unit length made by the machine illustrated in FIG. 15*a*.

FIG. 15*a* shows another exemplary embodiment of a filter-manufacturing machine for producing the double compound filter 118, which consists of respectively four different filter segments. As shown in FIG. 15*b*, two different types of granulate materials 26 and 27 are inserted into this double compound filter 118. As compared to the embodiment shown in FIG. 14*a*, the embodiment of FIG. 15*a* shows two additional granulate modules 133 and 133', each having a granulate cylinder 126" and 126'", respectively, added to the filter-manufacturing machine in order to add another granulate. Granulate module 133 is positioned between the tube feed module 130 and granulate and soft element filling module 131, and granulate module 133' is positioned between the rotating module 132 and the additional granulate and soft element filling module 131'. The elements used herein are otherwise the same.

The modular design of the filter-manufacturing machine according to the invention allows filters to be manufactured in accordance with the desires of the respective clients. For this, it is only necessary to replace, add or remove the respective modules.

Even though the description of the Figures for the most part refers only to production variants using a vertical orientation of the filter tubes 11, these tubes can also be oriented in a horizontal direction. The invention is furthermore not limited to the use of the respective cylinders. It is also possible to use trough belts for conveying and processing the filters, for example, as disclosed in German Patent No. 197 08 836 and corresponding U.S. Pat. No. 6,079,545 owned by the assignee of the present application, German Patent No. 39 25 073 and its U.S. counterpart U.S. Pat. No. 5,209,249 owned by G. D. Societa' per Azioni, Italy, or European Patent application 1 048 229 owned by Focke & Co (GmbH & Co.).

The filter-manufacturing concept of the present invention is focused on alternately inserting filter plugs made of different filtering materials and/or granulates into filter tubes and to process these to make multi-segment or compound filters. Within the framework of the present invention, the term "filtering materials" also includes the term "granulates."

Pre-fabricated filter tubes having at least twice the unit length and a loose or glued-in filter element in the center are preferably used. The plugs conveyed are normally 8 mm long and are subsequently divided into 4 mm long plugs. In an embodiment slightly modified to match the embodiment shown in FIG. 11, the filter tube is held in a depression of the merry-go-round or the main cylinder 100 and is conveyed from station to station by the rotation of the main cylinder 100. Depending on the filter design, the stations in alternating sequence are: a tube feeding device, a granulate metering device with granulate feeding station and a filter plug feeding device, a filter rotating device and, again, a granulate metering device with granulate feeding station and a filter plug feeding device or simply a granulate feeding station and a filter plug device. Except during the rotating, the tube is always held at the same location in the main cylinder 100. When feeding filtering material or inserting it into the tube, the tube is preferably held in position with the aid of a vacuum or suction air. The tube holder can be vibrated, for example, so that the granulate can be packed in as densely as possible.

Figure 16:
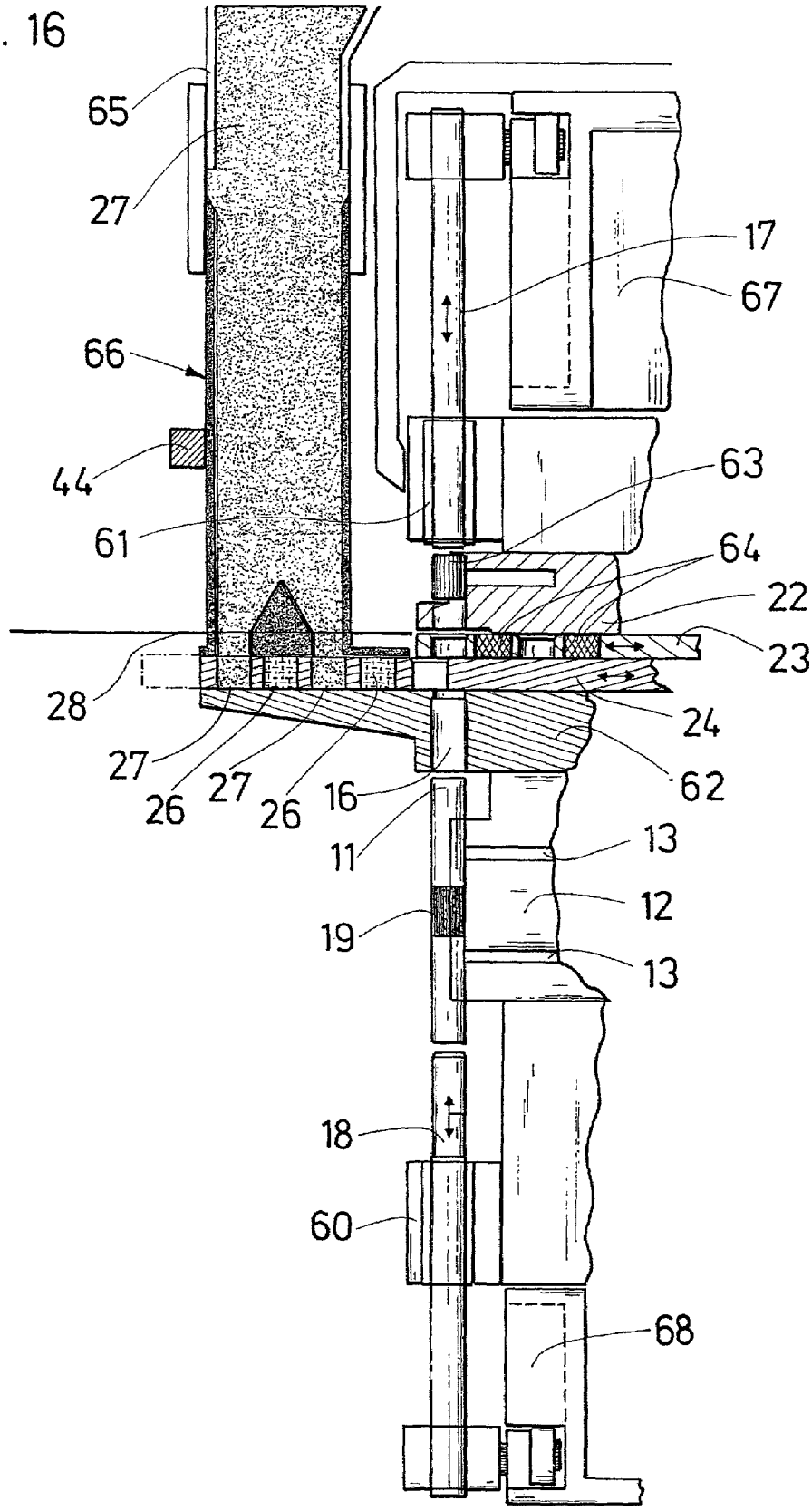
FIG. 16 shows a sectional representation of an additional embodiment of a transfer station, having additional features as compared to the exemplary embodiment shown in FIGS. 1–8.

FIG. 16 schematically shows another embodiment of a transfer station for transferring filter elements to a tube 11 that already contains a first filtering element 19. The tube 11 is held in the operating position, shown in FIG. 16, by means of vacuum bores 13 on the conveying cylinder 12. In order to insert the tube 11 into the bore 16 of tube disc 62, this disc 62 is moved upward with a bottom push rod 18, which is moved upward through a push rod guide 60. The bottom push rod 18 is operatively connected to a bottom control cam 68, which determines how far the bottom push rod 18 is moved either upward or downward.

The first pusher 23 already contains two second-filter plugs 64. Following the cutting of a first double filter plug 63 with a circular blade 28, the additional receptacles of the first pusher 23 are also respectively provided with a first filter plug. The upper push rod 17 that is guided inside a push rod guide 61, among other things, is used for this. The upper push rod 17 is operatively connected to an upper control cam 67, which determines how far the upper push rod 17 is extended either upward or downward. In FIG. 16, the upper push rod 17 is located in the top position.

The granulate receptacles provided on a second pusher 24 already contain a first granulate 26. FIG. 16 shows the state in which a second granulate 27 is filled from a granulate container 65 via a filling pipe 66 into additional receptacles of the second pusher 24. An oscillator 44 that is operatively connected to the filling pipe 66 is provided to achieve the highest possible packing density or filling density of the second granulate 27. The oscillator 44 may oscillate with a frequency of 50 Hz and can be an electromagnet with a correspondingly moving mass, so that respective oscillations are generated.

FIGS. 17 and 18 show an embodiment where a main cylinder 100 that is slightly modified relative to the main cylinder 100 in FIG. 11 is supplied with filter elements or filtering material. It also shows the removal of double compound filters 118 or double multi-segment filters 118, produced in the main cylinder 100.

In a tube mass flow 101, tubes 114 with 4 times the unit length are fed to a holding cylinder 78. By means of the holding cylinder 78, the tubes 114 with 4 times the unit length are removed from the supply of tubes in the respective receptacles of holding cylinder 78. Following this, the tubes are cut with a circular blade 106 into two tubes 115 with double the unit length. The respective tubes 115 with 2 times the usable length are then staggered in a staggering cylinder 79 and are subsequently transferred to a sliding cylinder/transfer cylinder 80, where they are aligned. The sliding cylinder/transfer cylinder 80 is arranged behind a cone shaped deflection cylinder 81 which is provided for additional filter elements that are fed from above into the sliding cylinder/transfer cylinder 80.

The respective positions of the filter elements according to FIG. 17 are shown schematically in FIG. 18.

Filter elements with 12 times the unit length 70 are transferred from a filter element mass flow 102 or a corresponding filter element supply to a holding cylinder 74 with receptacles. These filter elements are subsequently cut with a circular blade 106 into three segments to create three filter elements with 4 times the unit length 71, which are then stacked in a staggering cylinder 75 and arranged cross-axially aligned inside a sliding cylinder 76. Subsequently, the filter elements are again cut with a circular blade 106 and divided into two filter elements with 2 times the unit length 72.

After being divided into two filter segments with 2 times the unit length 72, the filter elements are staggered in a staggering cylinder 77 and are then transferred to a transfer cylinder/sliding cylinder 80. For this exemplary embodiment, the filter elements with 2 times the unit length 72 are arranged in front and the tubes with 2 times the unit length 115 are arranged behind them, so that only the frontal filter elements with 2 times the unit length 72 can be seen. The respective filter elements 72 and 115 are then transferred to a cone-shaped deflection cylinder 81 or 82 and are then transferred via a transfer cylinder 83 or 84 onto the main cylinder 100. The main cylinder 100 is not shown in FIG. 17 for reasons of clarity, but is shown schematically in FIG. 18. After filling the tubes 115, the double compound filters 118 or the multi-segment filters 118 are taken over by a takeover cylinder 85 and are supplied to a cone-shaped deflection cylinder 86. Finally, they are transferred to a removal cylinder 87 that removes the multi-segment filters 118 to a mass flow 88. The multi-segment filters or double compound filters 118, created in this way for the exemplary embodiment, are provided with respectively one filter element 73 at the end and respectively one granulate filling toward the center. These filters are produced on the main cylinder 100 and are provided in the center with the known filter plug or the first filtering material 19.

FIGS. 17 and 18 thus show three main functions, namely the feeding of pre-fabricated tubes 11 via a previously formed mass flow, the feeding of filter elements, such as the soft filter elements with corresponding function groups, as shown in the exemplary embodiment, and the removal of the finished product produced in the main cylinder 100 with corresponding conveying cylinders that form a new mass flow.

It will be understood that the above description of the present invention is susceptible to various modifications, changes and adaptations, and the same are intended to be comprehended within the meaning and range of equivalents of the appended claims.

What is claimed is:

1. An arrangement for manufacturing compound filters for products in the tobacco-processing industry, comprising:

a filter tube feeding element;

at least one processing station one of which comprises a rotating device for rotating filter tubes; and at least one conveyor into which filter tubes are deposited from the feeding element for supplying the filter tubes to the at least one processing station, wherein one of the processing stations comprises at least one filtering material feeding station, the at least one filtering material feeding station comprising two off-center arranged rotating discs that are respectively provided with bores, with the bores of one disc and the bores of the other disc being arranged so as to be aligned at one location.

2. The arrangement according to claim 1, wherein the filter tubes are pre-manufactured wrapping material sections formed into tubes and containing a filter element arranged in a central region of each respective section.

3. The arrangement according to claim 1, wherein the at least one conveyor comprises a continuously circulating conveyor in which the filter tubes are conveyed cross-axially.

4. The arrangement according to claim 1, wherein the at least one conveyor comprises a single conveyor and the at least one processing station is arranged on the single conveyor.

5. The arrangement according to claim 1, wherein the at least one conveyor comprises a plurality of conveyors and at least one of the processing stations is assigned to some of the conveyors and maximally one processing station is assigned to other conveyors.

6. The arrangement according to claim 5, wherein maximally one processing station is assigned to each conveyor.

7. The arrangement according to claim 1, wherein one of the processing stations comprises at least one filtering material insertion station.

8. The arrangement according to claim 1, wherein one of the processing stations comprises at least one removal station.

9. The arrangement according to claim 1, wherein one of the processing stations comprises at least one heating station.

10. The arrangement according to claim 7, wherein the at least one filtering material insertion station comprises at least one first transfer means for inserting filtering material into the filter tubes.

11. The arrangement according to claim 10, wherein the at least one filtering material insertion station includes at least one second transfer means that functions from the opposite end of the filter tube as a counter stop to the at least one first transfer means.

12. The arrangement according to claim 1, further including means for axially aligning the at least one filter tube with at least one of the bores.

13. The arrangement according to claim 12, wherein the axial aligning means is for aligning at least two of the bores with the filter tube.

14. An apparatus for producing compound filters for products in the tobacco-producing industry, comprising:

a filter-tube feeding element;

at least one conveyor into which filter tubes are insertable from the feeding element; and at least one processing station for being supplied with the filter tubes by the at least one conveyor, wherein at least one of the processing stations is a filtering materials insertion station including means for inserting two portions of filtering materials into a filter tube in a single operational step, wherein at least one of the processing stations comprises a filtering material feeding station that includes two rotating and eccentrically arranged discs that are respectively provided with bores, with the bores of one disc and the bores of the other disc being positioned so that they are aligned at one location.

15. The apparatus according to claim 14, including means for arranging at least one filter tube so that it is axially aligned with at least two bores.

16. The apparatus according to claim 14, wherein one of the processing stations comprises a rotating mechanism for rotating the filter tubes.

17. The apparatus according to claim 14, wherein the at least one conveyor comprises at least one continuously circulating conveyor which conveys the filter tubes cross-axially.

18. The apparatus according to claim 14, wherein the at least one conveyor comprises a single conveyor and at least one of the processing stations is arranged on the single conveyor.

19. The apparatus according to claim 14, wherein the at least one conveyor comprises a plurality of conveyors and at least one processing station is associated with each of the conveyors.

20. The apparatus according to claim 14, wherein a maximum of one processing station is associated with each of the conveyors.

21. The apparatus according to claim 14, wherein the at least one conveyor comprises multiple conveyors, one of the conveyors being associated with at least one processing station and at least one of the conveyors being associated with only one of the processing stations.

22. The apparatus according to claim 14, wherein the filter tube has one end and said means for inserting comprises at least a first transfer means for inserting the at least two portions of the filtering materials in a single operational step into the one end of the filter tube.

23. The apparatus according to claim 22, wherein the filter tube has another end opposite the one end, and the first transfer means comprises at least one first plunger and the filtering material insertion station includes at least one second transfer means for proving at the opposite end of the filter tube a counter support to the at least one first plunger.

24. An arrangement for manufacturing compound filters for products in the tobacco-processing industry, comprising:

a filter tube feeding element;

a plurality of processing stations; and a single conveyor into which filter tubes are deposited from the feeding element for supplying the filter tubes to the processing stations wherein one of the processing stations comprises at least one removal station.

25. The arrangement according to claim 24, wherein another one of the processing stations comprises a rotating device for rotating filter tubes.

26. The arrangement according to claim 24, wherein the conveyor comprises a continuously circulating conveyor in which the filter tubes are conveyed cross-axially.

27. The arrangement according to claim 24, wherein another one of the processing stations comprises at least one filtering material feeding station.

28. The arrangement according to claim 24, wherein another one of the processing stations comprises at least one filtering material insertion station.

29. The arrangement according to claim 24, wherein another one of the processing stations comprises at least one heating station.

30. An arrangement for manufacturing compound filters for products in the tobacco-processing industry, comprising:

a filter tube feeding element;

a plurality of processing stations; and a single conveyor into which filter tubes are deposited from the feeding element for supplying the filter tubes to the processing stations wherein one of the processing stations comprises at least one filtering material feeding station and the at least one filtering material feeding station comprises two off-center arranged rotating discs that are respectively provided with bores, with the bores of one disc and the bores of the other disc being arranged so as to be aligned at one location.

31. The arrangement according to claim 27, wherein the at least one filtering material feeding station comprises at least one sliding element provided with bores.

32. The arrangement according to claim 27, wherein the at least one filtering material feeding station comprises at least one lever element provided with bores.

33. The arrangement according to claim 28, wherein the at least one filtering material insertion station comprises at least one first transfer means for inserting filtering material into the filter tubes.

34. The arrangement according to claim 33, wherein the at least one filtering material insertion station includes at least one second transfer means that functions from the opposite end of the filter tube as a counter stop to the at least one first transfer means.

35. An arrangement for manufacturing compound filters for products in the tobacco-processing industry, comprising:

a filter tube feeding element;

a plurality of processing stations; and a single conveyor into which filter tubes are deposited from the feeding element for supplying the filter tubes to the processing stations wherein one of the processing stations comprises at least one filtering material feeding station and the at least one filtering material feeding station comprises two off-center arranged rotating discs that are respectively provided with bores, with the bores of one disc and the bores of the other disc being arranged so as to be aligned at one location, further including means for axially aligning the at least one filter tube with at least one of the bores.

36. The arrangement according to claim 35, wherein the axial aligning means is for aligning at least two of the bores with the filter tube.

37. An apparatus for producing compound filters for products in the tobacco-producing industry, comprising:

a filter-tube feeding element;

a single conveyor into which filter tubes are insertable from the feeding element; and a plurality of processing stations for being supplied with the filter tubes by the conveyor, wherein at least one of the processing stations is a filtering materials insertion station including means for inserting two portions of filtering materials into a filter tube in a single operational step.

38. The apparatus according to claim 37, wherein one of the processing stations comprises a rotating mechanism for rotating the filter tubes.

39. The apparatus according to claim 37, wherein the conveyor is a continuously circulating conveyor which conveys the filter tubes cross-axially.

40. The apparatus according to claim 37, wherein at least one of the processing stations comprises a filtering material feeding station that includes two rotating and eccentrically arranged discs that are respectively provided with bores, with the bores of one disc and the bores of the other disc being positioned so that they are aligned at one location.

41. The apparatus according to claim 40, including means for arranging at least one filter tube so that it is axially aligned with at least two bores.

42. The apparatus according to claim 37, wherein at least one of the processing stations includes a filtering material feeding station comprising at least one of (a) at least one pusher element provided with bores and (b) at least one lever element provided with bores.

43. The apparatus according to claim 37, wherein the filter tube has one end and said means for inserting comprises at least a first transfer means for inserting the at least two portions of the filtering materials in a single operational step into the one end of the filter tube.

44. The apparatus according to claim 41, wherein the filter tube has another end opposite the one end, and the first transfer means comprises at least one first plunger and the filtering material insertion station includes at least one second transfer means for proving at the opposite end of the filter tube a counter support to the at least one first plunger.

45. A compound filter manufacturing system for products in the tobacco-processing industry, comprising:

a filter-tube feeding apparatus;

a single conveyor for conveying filter tubes supplied by the filter-tube feeding apparatus along a predetermined movement path; and a plurality of processing stations receiving filter tubes from the conveyor, said processing stations including at least one processing station for inserting at least two portions of filtering materials into at least one filter tube during one operational step.

46. The filter-manufacturing system according to claim 45, wherein one of the processing stations comprises a rotating device for rotating the filter tubes.

47. The filter-manufacturing system according to claim 45, wherein the conveyor is a continuously circulating conveyor for conveying the filter tubes cross-axially.

* * * * *